US012343650B2

(12) United States Patent
Hasegawa et al.

(10) Patent No.: US 12,343,650 B2
(45) Date of Patent: Jul. 1, 2025

(54) ROBOT, ROBOT CONTROL METHOD, AND STORAGE MEDIUM

(71) Applicant: CASIO COMPUTER CO., LTD., Tokyo (JP)

(72) Inventors: Hirokazu Hasegawa, Koganei (JP); Atsushi Shibutani, Tokorozawa (JP); Yoshihiro Kawamura, Fussa (JP); Miyuki Urano, Akiruno (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 719 days.

(21) Appl. No.: 17/666,650

(22) Filed: Feb. 8, 2022

(65) Prior Publication Data

US 2022/0297018 A1 Sep. 22, 2022

(30) Foreign Application Priority Data

Mar. 16, 2021 (JP) ..... 2021-042129

(51) Int. Cl.
*A63H 13/00* (2006.01)
*A63H 29/22* (2006.01)

(52) U.S. Cl.
CPC ..... *A63H 29/22* (2013.01); *A63H 13/005* (2013.01); *A63H 2200/00* (2013.01)

(58) Field of Classification Search
CPC ... A63H 29/22; A63H 13/005; A63H 2200/00
See application file for complete search history.

(56) References Cited

U.S. PATENT DOCUMENTS 4,312,150 A * 1/1982 Terzian ..... A63H 11/18 446/354
6,048,209 A * 4/2000 Bailey ..... G09B 23/281 434/238

(Continued)

FOREIGN PATENT DOCUMENTS

JP 2002323900 A 11/2002
JP 2003071756 A 3/2003

(Continued)

OTHER PUBLICATIONS

Japanese Office Action (and an English language translation thereof) dated Feb. 21, 2023, issued in counterpart Japanese Application No. 2021-042129.

*Primary Examiner* — Dmitry Suhol
*Assistant Examiner* — Jason Pinheiro
(74) *Attorney, Agent, or Firm* — Holtz, Holtz & Volek PC

(57) ABSTRACT

A robot includes: a body part capable of contacting a placement surface; a head part connected to a front end of the body part to be rotatable about a first axis of rotation extending in a front-back direction of the body part and rotatable about a second axis of rotation extending in a width direction of the body part, and capable of contacting the placement surface; a drive unit which performs a rotation about the first axis of rotation and a rotation about the second axis of rotation independently of each other to drive the head part; and a processor which controls the drive unit to perform preparation control to rotate the head part about the second axis of rotation by a preparation angle and vibration control to alternately repeat forward rotation and reverse rotation of the head part about the first axis of rotation.

9 Claims, 19 Drawing Sheets

(56) References Cited

U.S. PATENT DOCUMENTS 6,462,498 B1 * 10/2002 Filo ..... A63H 11/20 446/355
6,463,356 B1 * 10/2002 Hattori ..... B62D 57/032 701/25
6,506,095 B1 * 1/2003 Lund ..... A63H 3/28 446/268
6,529,802 B1 * 3/2003 Kawakita ..... B25J 19/021 709/219
6,760,645 B2 * 7/2004 Kaplan ..... A63H 11/00 901/1
7,066,782 B1 * 6/2006 Maddocks ..... A63H 13/02 446/280
7,089,083 B2 * 8/2006 Yokoo ..... G06N 3/006 901/1
7,115,014 B2 * 10/2006 McGrath ..... A63H 13/02 446/483
7,289,884 B1 * 10/2007 Takahashi ..... B25J 9/1612 700/262
7,386,364 B2 * 6/2008 Mikami ..... B62D 57/02 318/568.22
7,400,939 B2 * 7/2008 Nagasaka ..... B62D 57/032 901/1
7,442,107 B1 * 10/2008 Ueda ..... A63H 11/20 446/175
7,761,184 B2 * 7/2010 Moridaira ..... G06N 3/008 700/250
7,762,863 B1 * 7/2010 Lund ..... A63H 13/12 446/175
7,896,112 B2 * 3/2011 Isozumi ..... B25J 19/0091 180/8.5
8,414,350 B2 * 4/2013 Rehkemper ..... A63H 11/20 446/376
9,016,158 B2 * 4/2015 Amino ..... F16H 19/08 901/26
10,118,290 B2 * 11/2018 Nagatsuka ..... B25J 5/00
10,807,246 B2 * 10/2020 Hong ..... B62D 57/032
11,103,800 B1 * 8/2021 Roberts ..... A63H 13/04
11,518,050 B2 * 12/2022 Cui ..... B25J 19/0029
12,090,419 B2 * 9/2024 Donaldson ..... A63H 29/22
2001/0049248 A1 * 12/2001 Choi ..... A63H 30/04 446/298
2004/0210347 A1 * 10/2004 Sawada ..... G06N 3/008 700/246
2010/0151767 A1 * 6/2010 Rehkemper ..... A63H 11/20 446/330
2017/0269589 A1 * 9/2017 Clarke ..... A63H 29/22
2018/0043838 A1 * 2/2018 Ellerman ..... G05D 1/0891
2018/0186002 A1 * 7/2018 Inoue ..... B25J 9/0087
2020/0110968 A1 * 4/2020 Onodera ..... G06V 10/82
2020/0324411 A1 * 10/2020 Li ..... B62D 57/032
2021/0069893 A1 * 3/2021 Hayashi ..... B25J 11/003
2021/0291385 A1 * 9/2021 Mathews ..... A63H 33/26
2021/0299852 A1 * 9/2021 Lindegaard ..... B25J 11/0005
2022/0055224 A1 * 2/2022 Michaelian ..... B25J 9/161
2022/0097230 A1 * 3/2022 Kawabe ..... A63H 11/18
2022/0118375 A1 * 4/2022 Donaldson ..... A63H 33/26
2022/0314133 A1 * 10/2022 Yokono ..... B25J 9/163
2022/0355470 A1 * 11/2022 Watanabe ..... B25J 13/00
2023/0271328 A1 * 8/2023 Sakurai ..... B25J 11/003 700/257
2024/0051147 A1 * 2/2024 Okumura ..... A63F 13/65
2024/0066420 A1 * 2/2024 Kawabe ..... A63H 11/20

FOREIGN PATENT DOCUMENTS

JP 2005103000 A 4/2005
JP 2005349545 A 12/2005
JP 2013121469 A 6/2013

* cited by examiner

FIG. 11

123

| BEHAVIORAL TRIGGER | BEHAVIOR TYPE | GROWTH VALUE | | | | | | | | | | |
|---|---|---|---|---|---|---|---|---|---|---|---|---|
| | | 0 | 1 | 2 | 3 | 4 | 5 | 6 | 7 | 8 | 9 | 10 |
| BODY IS RUBBED | BASIC BEHAVIOR 0-0 | 100 | 100 | 80 | 80 | 30 | 30 | 20 | 20 | 20 | 20 | 10 |
| | BASIC BEHAVIOR 0-1 | 0 | 0 | 20 | 20 | 50 | 50 | 20 | 20 | 20 | 20 | 10 |
| | BASIC BEHAVIOR 0-2 | 0 | 0 | 0 | 0 | 20 | 20 | 40 | 40 | 20 | 20 | 20 |
| | BASIC BEHAVIOR 0-3 | 0 | 0 | 0 | 0 | 0 | 0 | 20 | 20 | 20 | 20 | 20 |
| | PERSONALITY BEHAVIOR 0-0 | 0 | 0 | 0 | 0 | 0 | 0 | 0 | 0 | 20 | 20 | 40 |
| ROBOT IS TALKED TO | BASIC BEHAVIOR 1-0 | 100 | 90 | 80 | 80 | 60 | 60 | 30 | 30 | 30 | 30 | 30 |
| | BASIC BEHAVIOR 1-1 | 0 | 10 | 20 | 20 | 40 | 40 | 50 | 50 | 40 | 40 | 30 |
| | PERSONALITY BEHAVIOR 1-0 | 0 | 0 | 0 | 0 | 0 | 0 | 20 | 20 | 30 | 30 | 40 |
| THERE IS LOUD SOUND | BASIC BEHAVIOR 2-0 | 100 | 90 | 80 | 80 | 60 | 60 | 30 | 30 | 20 | 20 | 20 |
| | BASIC BEHAVIOR 2-1 | 0 | 10 | 20 | 20 | 40 | 40 | 50 | 50 | 20 | 20 | 20 |
| | BASIC BEHAVIOR 2-2 | 0 | 0 | 0 | 0 | 0 | 0 | 20 | 20 | 40 | 40 | 20 |
| | PERSONALITY BEHAVIOR 2-0 | 0 | 0 | 0 | 0 | 0 | 0 | 0 | 0 | 20 | 20 | 40 |
| CERTAIN PERIOD OF TIME HAS ELAPSED | BASIC BEHAVIOR 3-0 | 100 | 90 | 80 | 80 | 60 | 60 | 30 | 30 | 20 | 20 | 20 |
| | BASIC BEHAVIOR 3-1 | 0 | 10 | 20 | 20 | 40 | 40 | 50 | 50 | 20 | 20 | 20 |
| | BASIC BEHAVIOR 3-2 | 0 | 0 | 0 | 0 | 0 | 0 | 20 | 20 | 40 | 40 | 20 |
| | PERSONALITY BEHAVIOR 3-0 | 0 | 0 | 0 | 0 | 0 | 0 | 0 | 0 | 20 | 20 | 40 |
| ⋮ | ⋮ | ⋮ | ⋮ | ⋮ | ⋮ | ⋮ | ⋮ | ⋮ | ⋮ | ⋮ | ⋮ | ⋮ |

FIG. 12

124

| BEHAVIOR TYPE | PERSONALITY TYPE | BEHAVIORAL CONTENT |
|---|---|---|
| BASIC BEHAVIOR 0-0 | | YIPS |
| BASIC BEHAVIOR 0-1 | | BARKS |
| BASIC BEHAVIOR 0-2 | | MEOWS |
| BASIC BEHAVIOR 0-3 | | HOWLS |
| PERSONALITY BEHAVIOR 0-0 | CHEERFUL | YIPS CHEERFULLY |
| | ACTIVE | BARKS ACTIVELY |
| | SHY | MEOWS SHYLY |
| | SPOILED | HOWLS WITH SWEET VOICE |
| BASIC BEHAVIOR 1-0 | | ASKS WHAT? |
| BASIC BEHAVIOR 1-1 | | ASKS WHAT'S UP? |
| PERSONALITY BEHAVIOR 1-0 | CHEERFUL | ASKS CHEERFULLY WHAT'S UP? |
| | ACTIVE | ASKS ACTIVELY WHAT'S UP? |
| | SHY | ASKS SHYLY WHAT'S UP? |
| | SPOILED | ASKS WITH SWEET VOICE WHAT'S UP? |
| BASIC BEHAVIOR 2-0 | | CHIRPS SHORTLY |
| BASIC BEHAVIOR 2-1 | | SCREAMS |
| BASIC BEHAVIOR 2-2 | | HOOTS FOR LONG TIME |
| PERSONALITY BEHAVIOR 2-0 | CHEERFUL | CHIRPS CHEERFULLY |
| | ACTIVE | CHIRPS ACTIVELY |
| | SHY | CHIRPS SHYLY |
| | SPOILED | CHIRPS WITH SWEET VOICE |
| BASIC BEHAVIOR 3-0 | | MOVES WIGGLY |
| BASIC BEHAVIOR 3-1 | | LOOKS AROUND |
| BASIC BEHAVIOR 3-2 | | YAWNS |
| PERSONALITY BEHAVIOR 3-0 | CHEERFUL | CHEERFUL BEHAVIOR |
| | ACTIVE | ACTIVE BEHAVIOR |
| | SHY | SHY BEHAVIOR |
| | SPOILED | SPOILED BEHAVIOR |
| ⋮ | ⋮ | ⋮ |

FIG. 13

125

| BEHAVIOR TYPE | TIME (ms) | TWIST MOTOR | VERTICAL MOTOR | VOICE DATA |
|---|---|---|---|---|
| ⋮ | ⋮ | ⋮ | ⋮ | ⋮ |
| BASIC BEHAVIOR 2-0 (WHEN SURPRISED AT LOUD SOUND) | 100 | 0 | 0 | VOICE DATA TO CHIRP SHORTLY |
| | 100 | 0 | -24 | |
| | 700 | 0 | -24 | |
| | 500 | 34 | -24 | |
| | 400 | -34 | -24 | |
| | 500 | 0 | 0 | |
| ⋮ | ⋮ | ⋮ | ⋮ | ⋮ |
| PERSONALITY BEHAVIOR 2-0 CHEERFUL (WHEN SURPRISED AT LOUD SOUND) | 100 | 0 | 0 | VOICE DATA TO CHIRP CHEERFULLY |
| | 100 | 0 | -24 | |
| | 700 | 0 | -24 | |
| | 500 | 34 | -24 | |
| | 400 | -34 | -24 | |
| | 500 | 0 | 0 | |
| ⋮ | ⋮ | ⋮ | ⋮ | ⋮ |
| SPONTANEOUS MOVEMENT 0-0 (BREATHING MOVEMENT) | 750 | 0 | 30 | NO VOICE |
| | 800 | 0 | 24 | |
| ⋮ | ⋮ | ⋮ | ⋮ | ⋮ |

ROBOT, ROBOT CONTROL METHOD, AND STORAGE MEDIUM

BACKGROUND OF THE INVENTION

Field of the Invention

This disclosure relates to a robot, a robot control method, and a storage medium.

Related Art

Robots capable of expressing the sense of creatures by having the appearance of the creatures and behaving like creatures have been developed. For example, Japanese Unexamined Patent Application Publication No. 2002-323900 discloses a pet robot capable of expressing the sense of a creature by using a motor such as to drive legs to walk and to wag its tail.

SUMMARY OF THE INVENTION

One aspect of a robot according to the present disclosure includes:

a body part capable of contacting a placement surface;

a head part connected to a front end of the body part to be rotatable about a first axis of rotation extending in a front-back direction of the body part and rotatable about a second axis of rotation extending in a width direction of the body part, and capable of contacting the placement surface;

a drive unit which performs a rotation about the first axis of rotation and a rotation about the second axis of rotation independently of each other to drive the head part; and a processor, wherein the processor controls the drive unit to perform preparation control to rotate the head part about the second axis of rotation to a preparation angle and vibration control to alternately repeat forward rotation and reverse rotation of the head part about the first axis of rotation.

BRIEF DESCRIPTION OF THE DRAWINGS

FIG. 11 is a diagram for describing an example of a growth table according to the embodiment.

FIG. 12 is a diagram for describing an example of a behavioral content table according to the embodiment.

FIG. 13 is a diagram for describing an example of a motion table according to the embodiment.

DETAILED DESCRIPTION OF THE INVENTION

Figure 1:
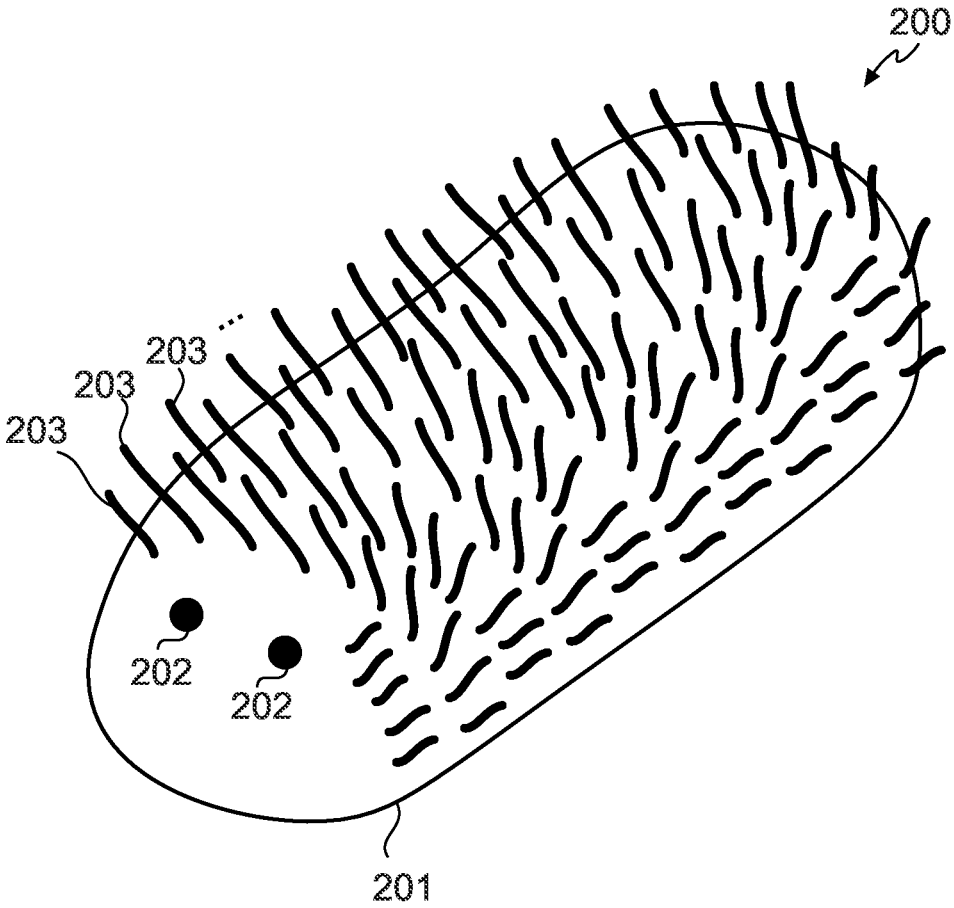
FIG. 1 is a diagram illustrating the appearance of a robot according to an embodiment.

An embodiment of the present disclosure will be described below with reference to the accompanying drawings. Note that the same or equivalent parts in the drawings are given the same reference numerals.

Embodiment

Figure 2:
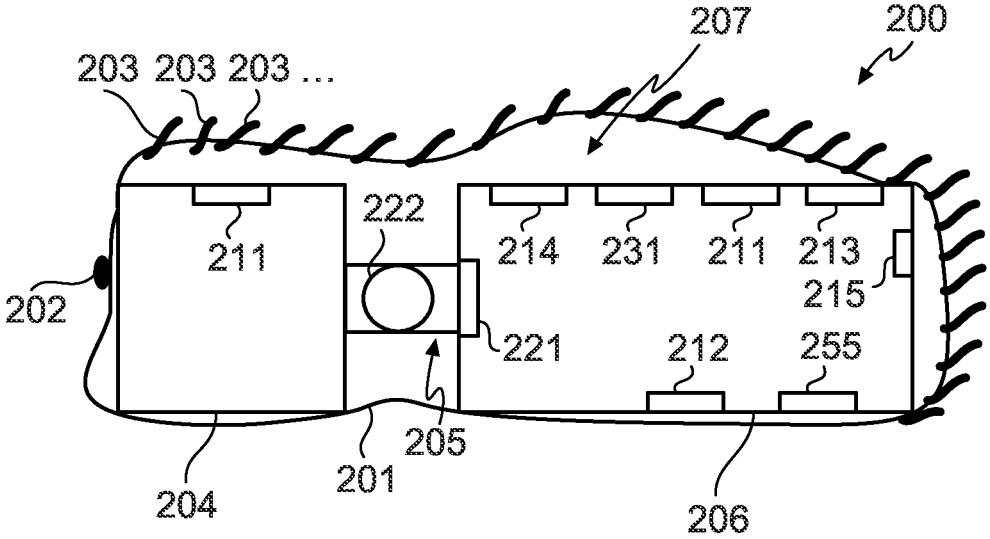
FIG. 2 is a sectional view of the robot according to the embodiment as seen from a side.

The embodiment in which an equipment control device in the present disclosure is applied to a robot 200 illustrated in FIG. 1 will be described with reference to the accompanying drawings. The robot 200 according to the embodiment is a pet robot powered by a rechargeable battery and imitating a small animal. As illustrated in FIG. 1, the robot 200 is covered with an outer covering 201 having decorative parts 202 that imitate eyes and bushy hair 203. Further, a casing 207 of the robot 200 is stored inside the outer covering 201. As illustrated in FIG. 2, the casing 207 of the robot 200 is composed of a head part 204, a connection part 205, and a body part 206, and the head part 204 and the body part 206 are connected by the connection part 205.

In the following description, on the assumption that the robot 200 is put normally on a placement surface such as a floor, the direction of a side corresponding to a face of the robot 200 (a side of the head part 204 opposite to the body part 206) is referred to as "front," and the direction of a side corresponding to a buttock (a side of the body part 206 opposite to the head part 204) is referred to as "back." Further, the direction of a side that comes into contact with the placement surface when the robot 200 is put normally on the placement surface is referred to as "down," and the direction opposite thereto is referred to as "up." Then, a direction perpendicular to a straight line extending in the front-back direction of the robot 200 and perpendicular to a straight line extending in the up-down direction is referred to as a width direction.

As illustrated in FIG. 2, the body part 206 extends in the front-back direction. Then, the body part 206 is in contact with the placement surface, such as the floor or a table on which the robot 200 is placed, through the outer covering 201. Further, as illustrated in FIG. 2, a twist motor 221 is provided in a front end portion of the body part 206, and the head part 204 is connected to the front end portion of the body part 206 through the connection part 205. Then, a vertical motor 222 is provided in the connection part 205. Note that the twist motor 221 is provided in the body part 206 in FIG. 2, but it may be provided in the connection part 205 or provided in the head part 204.

Figure 3:
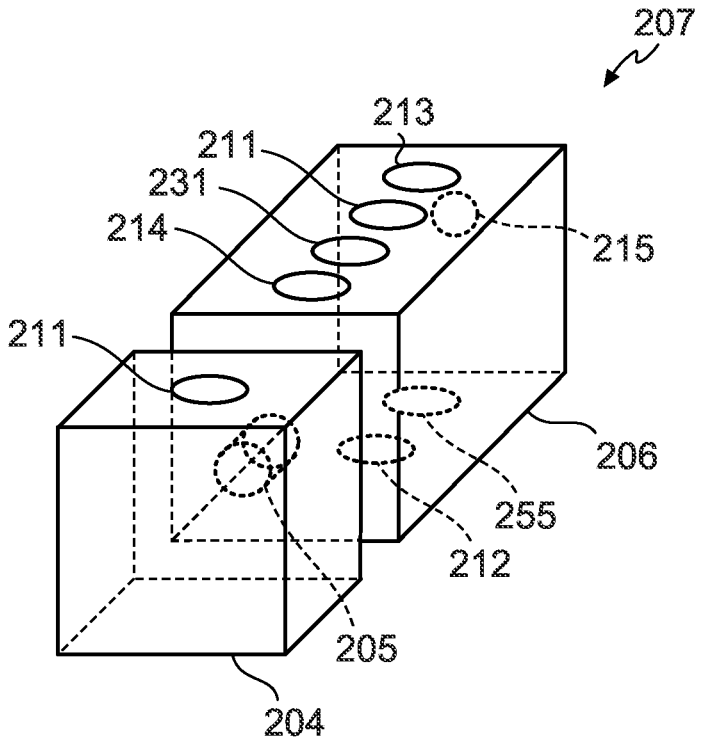
FIG. 3 is a diagram for describing a casing of the robot according to the embodiment.
Figure 4:
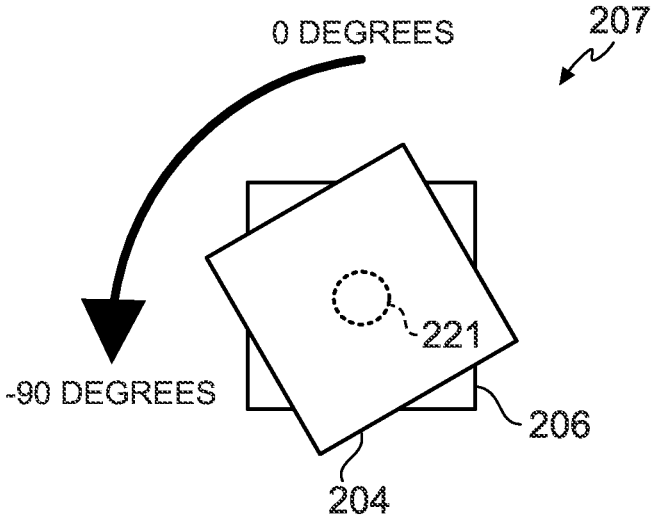
FIG. 4 is a diagram for describing an example of the movement of a twist motor of the robot according to the embodiment.
Figure 5:
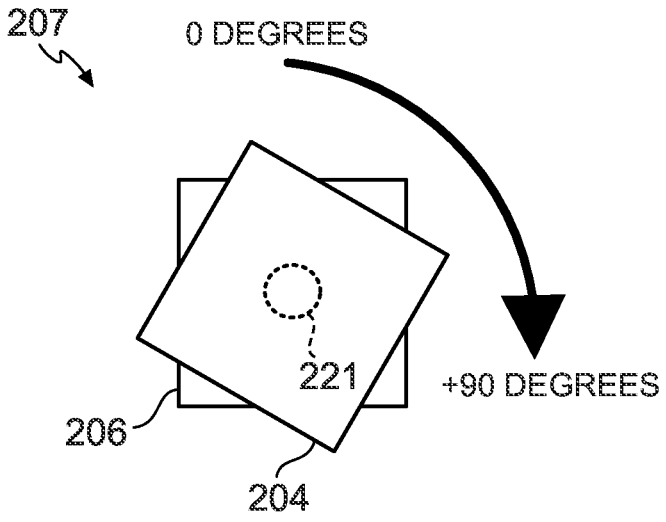
FIG. 5 is a diagram for describing another example of the movement of the twist motor of the robot according to the embodiment.

The connection part 205 connects the body part 206 and the head part 204 rotatably (by the twist motor 221) about a first axis of rotation extending in the front-back direction of the body part 206 through the connection part 205. As illustrated in FIG. 4 and FIG. 5 as front views of the casing 207, the twist motor 221 rotates (rotates forward) the head part 204 clockwise (right-hand turning) about the first axis of rotation with respect to the body part 206 within a forward rotation angle range, and rotates (rotates reversely) the head part 204 counterclockwise (left-hand turning) within a reverse rotation angle range. Note that "clockwise" in this description is clockwise when the direction of the head part 204 is seen from the body part 206. Further, the clockwise rotation is called "twist rotation to the right" and the counterclockwise rotation is called "twist rotation to the left." The maximum value of an angle to twistedly rotate the head part 204 to the right or to the left is optional, but it is assumed that the head part 204 is rotatable up to 90 degrees on both left and right sides in the present embodiment. In FIG. 4 and FIG. 5, the angle of the head part 204 in such a state that the head part 204 is not twisted to the right and to the left as illustrated in FIG. 3 (hereinafter "twist reference angle") is set to 0 degrees. Then, the angle when the head part 204 is twistedly rotated (rotated clockwise) furthermost to the right is set to −90 degrees, and the angle when the head part 204 is twistedly rotated furthermost to the left (rotated counterclockwise) is set to +90 degrees.

Figure 6:
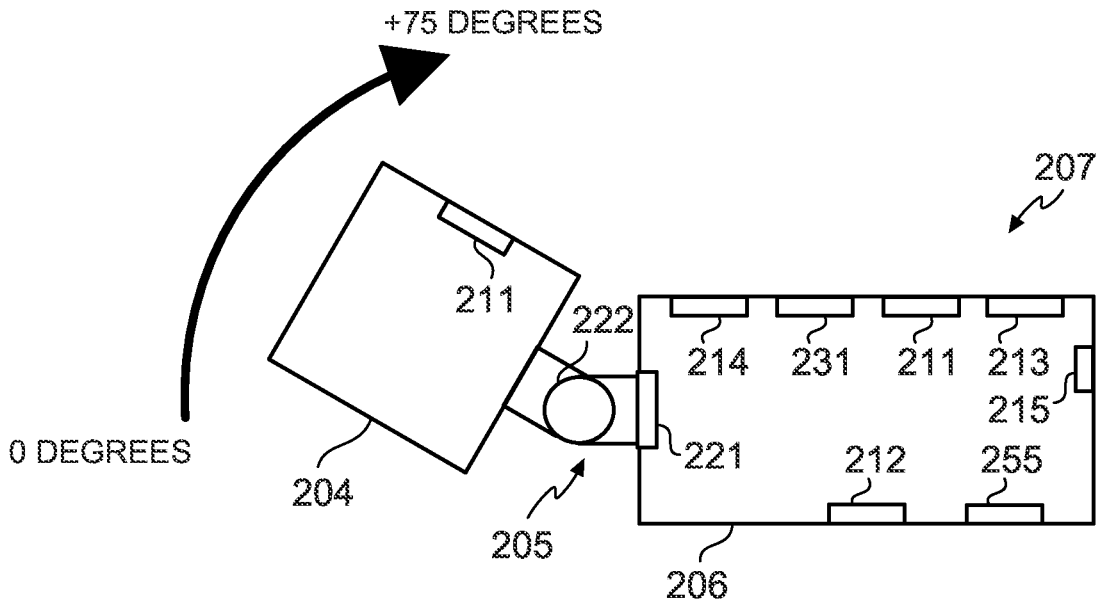
FIG. 6 is a diagram for describing an example of the movement of a vertical motor of the robot according to the embodiment.
Figure 7:
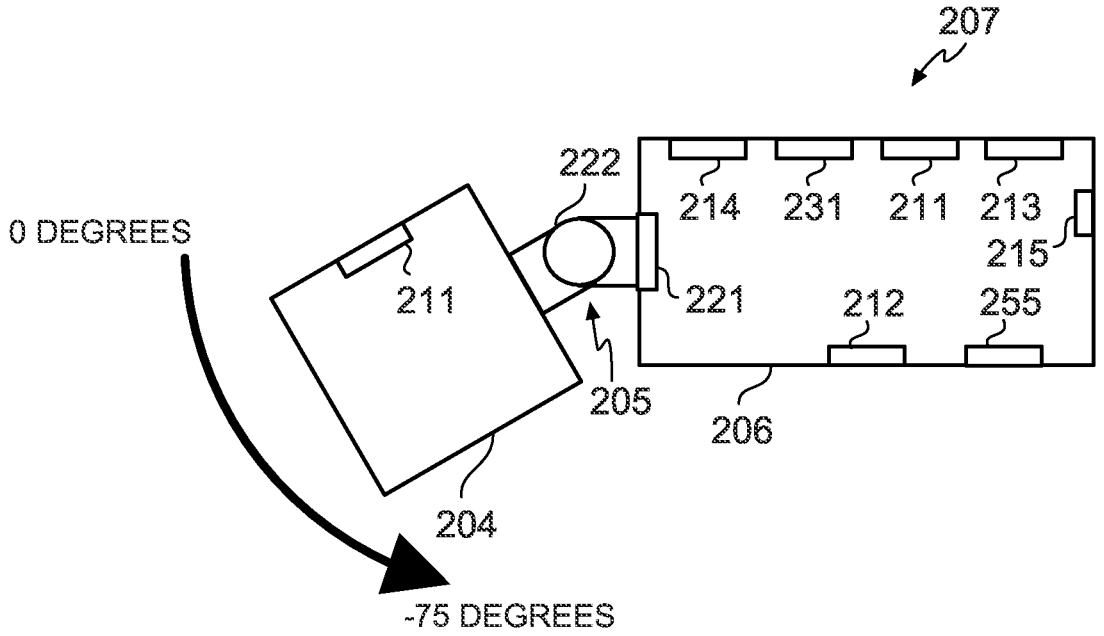
FIG. 7 is a diagram for describing another example of the movement of the vertical motor of the robot according to the embodiment.

Further, the connection part 205 connects the body part 206 and the head part 204 rotatably (by the vertical motor 222) about a second axis of rotation extending in the width direction of the body part 206 through the connection part 205. As illustrated in FIG. 6 and FIG. 7 as side views of the casing 207, the vertical motor 222 rotates (rotates forward) the head part 204 upward about the second axis of rotation within the forward rotation angle range or rotates (rotates reversely) the head part 204 downward within the reverse rotation angle range. The maximum value of an angle to rotate upward or downward is optional, but it is assumed that the head part 204 is rotatable up to 75 degrees on both up and down sides in the present embodiment. In FIG. 6 and FIG. 7, the angle of the head part 204 in such a state that the head part 204 is not rotated upward or downward as illustrated in FIG. 2 (hereinafter "up-down reference angle") is set to 0 degrees. When the head part 204 is rotated most downward, the angle is set to −75 degrees, while when the head part 204 is rotated most upward, the angle is set to +75 degrees. When the head part 204 is rotated by the up-down reference angle or rotated below the up-down reference angle about the second axis of rotation, the head part 204 can contact the placement surface, such as the floor or the table on which the robot 200 is placed, through the outer covering 201. Note that the example in which the first axis of rotation and the second axis of rotation are orthogonal to each other is illustrated in FIG. 2, but the first and second axes of rotation do not have to be orthogonal to each other.

Further, as illustrated in FIG. 2, the robot 200 has a touch sensor 211 in the head part 204 to be able to detect that a user rubs or hits the head part 204. The robot 200 also has the touch sensor 211 in the body part 206 to be able to detect that the user rubs or hits the body part 206.

Further, the robot 200 has an acceleration sensor 212 in the body part 206 to be able to detect the posture of the robot 200 itself, and to detect that the robot 200 is lifted up, turned around, or thrown away by the user. Further, the robot 200 has a microphone 213 in the body part 206 to be able to detect external sound. Further, the robot 200 has a speaker 231 in the body part 206 to be able to make the robot 200 cry or sing a song by using the speaker 231.

Further, the robot 200 has an illuminance sensor 214 in the body part 206 to be able to detect surrounding brightness. Note that since the outer covering 201 is made of a material that allows light to pass through, the surrounding brightness can be detected by the illuminance sensor 214 even if the robot 200 is covered with the outer covering 201.

Further, the robot 200 has a temperature sensor 215 in the body part 206 to be able to acquire ambient temperature.

Further, the robot 200 has a battery (not illustrated) as power supply to the twist motor 221, the vertical motor 222, and the like, and a wireless power-supply receiving circuit 255. The wireless power-supply receiving circuit 255 is provided in the body part 206 to receive power from a wireless charging device (not illustrated) provided separately from the robot 200 and used to charge the battery.

In the present embodiment, the acceleration sensor 212, the microphone 213, the illuminance sensor 214, the temperature sensor 215, and the speaker 231 are provided in the body part 206, but all or some of them may be provided in the head part 204. Further, in addition to the acceleration sensor 212, the microphone 213, the illuminance sensor 214, the temperature sensor 215, and the speaker 231 provided in the body part 206, all or some of them may also be provided in the head part 204. Further, the touch sensors 211 are provided in the head part 204 and the body part 206, respectively, but one touch sensor 211 may be provided in either the head part 204 or the body part 206. Further, two or more touch sensors 211 may be provided in each part.

Further, in the present embodiment, since the casing 207 of the robot 200 is covered with the outer covering 201, the head part 204 and the body part 206 are in indirect contact with the placement surface, such as the floor or the table on which the robot 200 is placed, through the outer covering 201. However, the present disclosure is not limited to such a form, and the head part 204 and the body part 206 may also be in direct contact with the placement surface. For example, a bottom part of the casing 207 (the part that comes into contact with the placement surface) may be bared without a bottom part of the outer covering 201 (the part that comes into contact with the placement surface), or the whole of the casing 207 may be bared without the whole of the outer covering 201.

Figure 8:
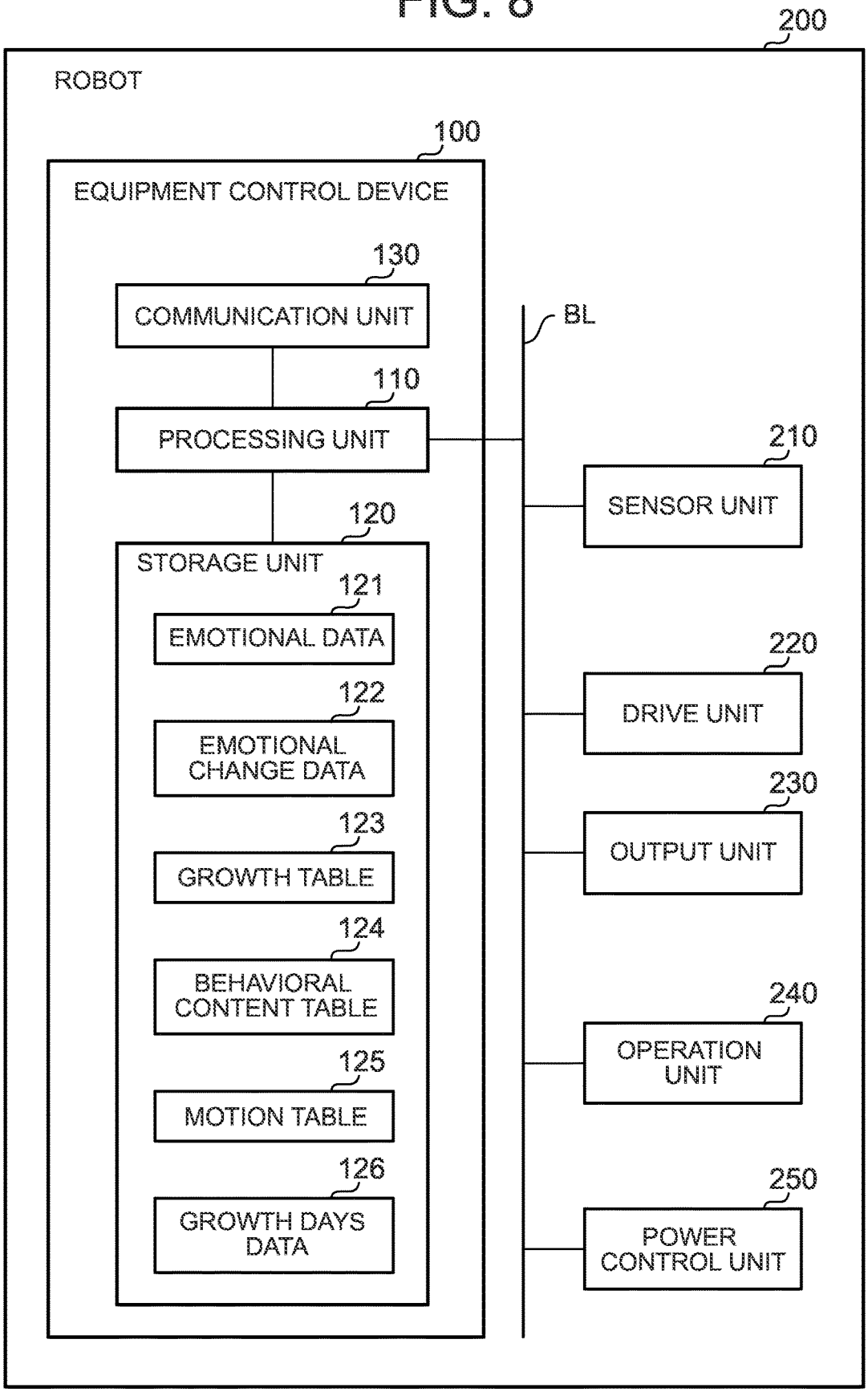
FIG. 8 is a block diagram illustrating the functional configuration of the robot according to the embodiment.

Next, the functional configuration of the robot 200 will be described. As illustrated in FIG. 8, the robot 200 includes an equipment control device 100, a sensor unit 210, a drive unit 220, an output unit 230, an operation unit 240, and a power control unit 250. Then, the equipment control device 100 includes a processing unit 110 as a processor, a storage unit 120, and a communication unit 130. In FIG. 8, the equipment control device 100 is connected to the sensor unit 210, the drive unit 220, the output unit 230, the operation unit 240, and the power control unit 250 through a bus line BL, but this is just an example. The equipment control device 100 may also be connected to the sensor unit 210, the drive unit 220, the output unit 230, the operation unit 240, and the power control unit 250 through a wired interface such as a USB (Universal Serial Bus) cable or through a wireless interface such as Bluetooth (registered trademark). Further, the processing unit 110 may be connected to the storage unit 120 and the communication unit 130 through the bus line BL or the like.

The equipment control device 100 controls the movement of the robot 200 by the processing unit 110 and the storage unit 120.

The processing unit 110 is composed, for example, of a CPU (Central Processing Unit) and the like to execute various processes by a program stored in the storage unit 120 in a manner to be described later. Note that since the processing unit 110 supports a multi-thread function of executing multiple processes in parallel, the various processes to be described later can be executed in parallel. Further, the processing unit 110 also has a clock function and a timer function to be able to count the date and time, and the like.

The storage unit 120 is composed of a ROM (Read Only Memory), a flash memory, a RAM (Random Access Memory), and the like. In the ROM, programs executed by the CPU of the processing unit 110 and data required in advance to execute the programs are stored. The flash memory is a writable nonvolatile memory in which data to be stored after power off are stored. In the RAM, data created or changed while a program is running are stored.

The communication unit 130 has a communication module that supports wireless LAN (Local Area Network), Bluetooth (registered trademark) and the like to perform data communication with an external device such as a smartphone. As the contents of data communication, for example, there are data communications to display, on the smartphone or the like, the battery remaining amount of the robot 200, receive a remaining amount notification request, and transmit battery remaining-amount information.

The sensor unit 210 includes the touch sensors 211, the acceleration sensor 212, the microphone 213, the illuminance sensor 214, and the temperature sensor 215 described above. The processing unit 110 acquires, through the bus line BL, detection values detected by various sensors included in the sensor unit 210 as external stimulus data representing external stimuli that act on the robot 200. Note that the sensor unit 210 may also include any sensor other than the touch sensors 211, the acceleration sensor 212, the microphone 213, the illuminance sensor 214, and the temperature sensor 215. As the types of sensors included in the sensor unit 210 increase, the types of external stimuli capable of being acquired by the processing unit 110 can increase. On the contrary, the sensor unit 210 does not have to include all the sensors described above. For example, when control based on surrounding brightness is unnecessary, the sensor unit 210 may not include the illuminance sensor 214.

Each of the touch sensors 211 detects contact with any object. The touch sensor 211 is, for example, a pressure sensor or a capacitance sensor. Based on the detected value from the touch sensor 211, the processing unit 110 acquires a contact strength and a contact time, and based on these values, the processing unit 110 can detect such an external stimulus that the robot 200 is rubbed or hit by the user (for example, see Japanese Unexamined Patent Application Publication No. 2019-217122). Note that the processing unit 110 may also detect these external stimuli by any sensor other than the touch sensor 211 (for example, see Japanese Patent No. 6575637).

The acceleration sensor 212 detects acceleration in three-axis directions composed of the front-back direction, the width (left-right) direction, and the up-down direction of the body part 206 of the robot 200. When the robot 200 stands still, since the acceleration sensor 212 detects gravitational acceleration, the processing unit 110 can detect the current posture of the robot 200 based on the gravitational acceleration detected by the acceleration sensor 212. Further, for example, when the user brings up or throws away the robot 200, the acceleration sensor 212 detects acceleration with the movement of the robot 200 in addition to the gravitational acceleration. Therefore, the processing unit 110 can detect the movement of the robot 200 by removing the gravitational acceleration component from the detected value detected by the acceleration sensor 212.

The microphone 213 detects sounds around the robot 200. Based on components of the sounds detected by the microphone 213, the processing unit 110 can detect, for example, that the user calls to the robot 200 or claps his/her hands.

The illuminance sensor 214 has a light-receiving element such as a photodiode to detect surrounding brightness (illuminance). For example, when it is detected by the illuminance sensor 214 that the surroundings are dark, the processing unit 110 can perform control to put the robot 200 to sleep in a pseudo manner (to set the robot 200 to a sleep control mode).

The temperature sensor 215 has a thermocouple, a resistance temperature detector, or the like to acquire ambient temperature. For example, when it is detected by the temperature sensor 215 that the ambient temperature is low, the processing unit 110 can perform control to shake (vibrate) the robot 200.

The drive unit 220 has the twist motor 221 and the vertical motor 222 as movable parts for expressing movements of the robot 200 (own machine). The drive unit 220 (the twist motor 221 and the vertical motor 222) is driven by the processing unit 110. The twist motor 221 and the vertical motor 222 are servo motors, which operate to rotate up to a specified operating angle position by the end of a specified operating time when the operating time and the operating angle are specified and instructed from the processing unit 110 to rotate. Note that the drive unit 220 may also have any other suitable actuator as a movable part, such as a fluid pressure motor. The processing unit 110 controls the drive unit 220 to cause the drive unit 220 to drive the head part 204 of the robot 200. Thus, the robot 200 can express gestures such as to lift up the head part 204 (rotate upward about the second axis of rotation) and to twist the head part 204 sideways (twistedly rotate to the right or to the left about the first axis of rotation). Gesture control data to make these gestures are recorded in a motion table 125 to be described later, and the movement of the robot 200 is controlled based on a detected external stimulus, a growth value to be described later, and the like.

The output unit 230 has the speaker 231, and sound is output from the speaker 231 by the processing unit 110 inputting sound data (for example, sampling data) to the output unit 230. For example, the robot 200 make pseudo animal's sounds by the processing unit 110 inputting sampling data of the animal's sounds of the robot 200 to the output unit 230. The sampling data of the animal's sounds are also recorded in the motion table 125, and an animal's sound is selected based on the detected external stimulus, the growth value to be described later, and the like. Note that the output unit 230 made up of the speaker 231 is also called a sound output unit.

Further, instead of or in addition to the speaker 231 as the output unit 230, a display such as a liquid crystal display or a light-emitting part such as an LED (Light Emitting Diode) may also be included to display an image or make the LED or the like to emit light based on the detected external stimulus, the growth value to be described later, and the like.

The operation unit 240 is composed, for example, of operation buttons, a volume knob, and the like. The operation unit 240 is an interface to accept operations by a user (an owner or a borrower) such as power on/off, volume adjustment of output sound, and the like. Note that the robot 200 may have only a power switch 241 inside the outer covering 201 as the operation unit 240 without having other operation buttons and volume knob to increase the sense of a creature. Even in this case, the operations such as the volume adjustment of the robot 200 can be performed by using an external smartphone or the like connected through the communication unit 130.

The power control unit 250 has a sub microcomputer, a charging IC (Integrated Circuit), a power control IC, a wireless power-supply receiving circuit 255, and the like to perform power control such as to charge the battery of the robot 200, acquire the battery remaining amount, and control power ON/OFF of main functional units that implement the main functions of the robot 200. Note that the main functional units are units excluding the power control unit 250 from the functional units that constitute the robot 200, which include the processing unit 110, the drive unit 220, and the like.

In the robot 200, the battery is charged wirelessly without connecting a charging cable or the like in order to give the sense of a creature. Although the wireless charging method is optional, an electromagnetic induction method is used in the present embodiment. When the robot 200 is put on a wireless charging device, an induced magnetic flux is generated between the wireless power-supply receiving circuit 255 provided on the bottom of the body part 206 and the external wireless charging device to charge the battery.

Next, emotional data 121, emotional change data 122, a growth table 123, a behavioral content table 124, the motion table 125, and growth days data 126 as characteristic data in the present embodiment among data stored in the storage unit 120 will be described in order.

Figure 9:
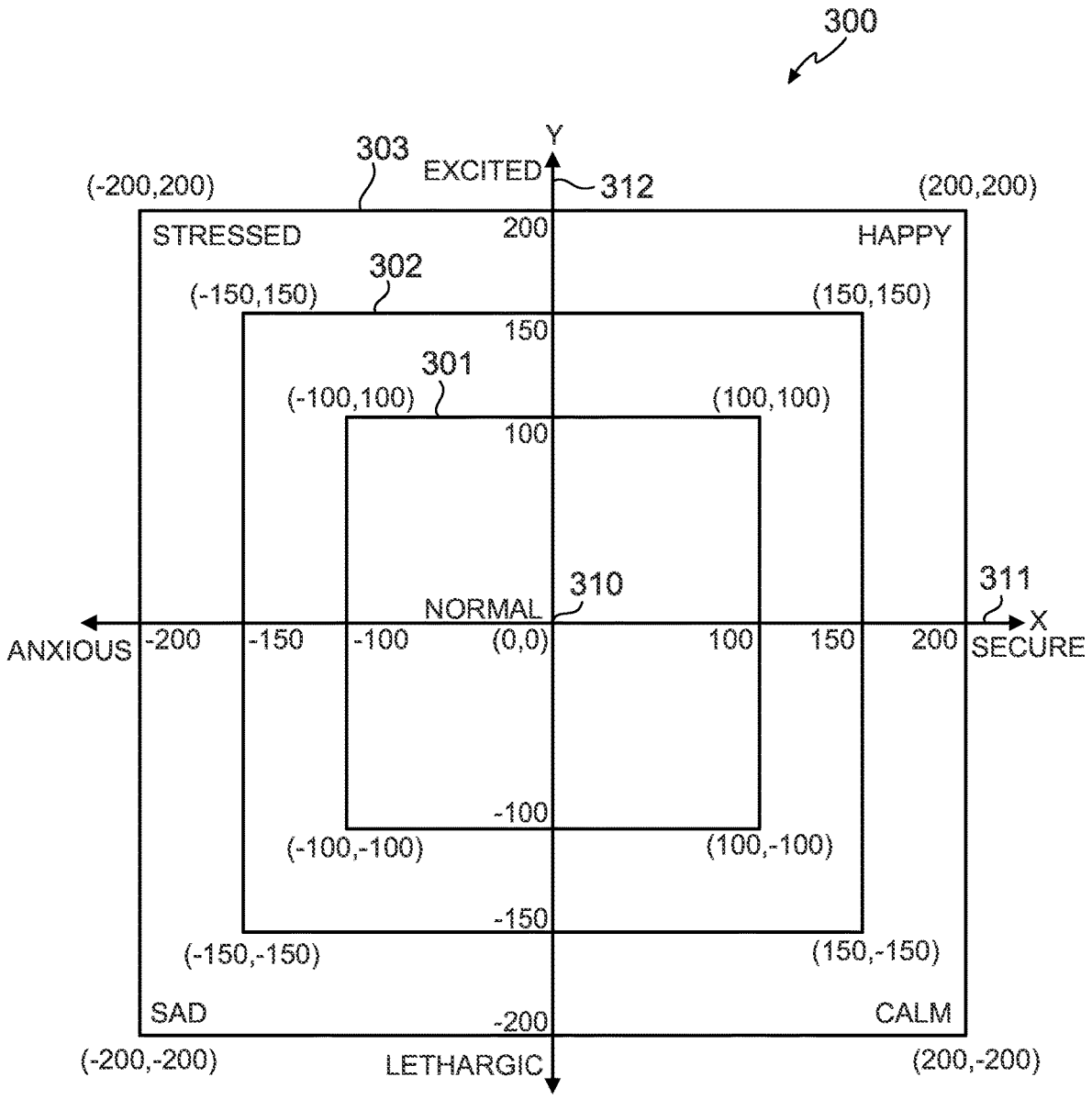
FIG. 9 is a diagram for describing an example of an emotional map according to the embodiment.

The emotional data 121 are data to make the robot 200 have pseudo emotions, which are data (X, Y) representing coordinates on the emotional map 300. As illustrated in FIG. 9, the emotional map 300 is represented in a two-dimensional coordinate system having an X axis 311 as an axis representing a degree of security (anxiety) and an Y axis 312 as an axis representing a degree of excitement (lethargy). An origin 310 (0, 0) on the emotional map represents a normal emotion. Then, when the value of the X coordinate (X value) is positive and the absolute value thereof increases, it means a higher degree of security, while when the value of the Y coordinate (Y value) is positive and the absolute value thereof increases, it means a higher degree of excitement. Further, when the X value is negative and the absolute value thereof increases, it means a higher degree of anxiety, while when the Y value is negative and the absolute value thereof increases, it means a higher degree of lethargy.

The emotional data 121 represents a plurality of pseudo emotions (four pseudo emotions in the present embodiment) different from one another. In the present embodiment, the degrees of security and anxiety are represented together on one axis (X axis) and the degrees of excitement and lethargy are represented together on one axis (Y axis) among values representing pseudo emotions. Therefore, the emotional data 121 have two values of the X value (security/anxiety) and the Y value (excitement/lethargy), and a point on the emotional map 300 represented by the X value and the Y value represents the pseudo emotion of the robot 200. The initial values of the emotional data 121 are (0, 0).

The emotional data 121 are data representing the pseudo emotion of the robot 200. Although the emotional map 300 is represented in the two-dimensional coordinate system in FIG. 9, the number of dimensions of the emotional map 300 is optional. The emotional map 300 may be defined one-dimensionally to set one value as the emotional data 121. Further, other one or more axes may be added to define the emotional map 300 in a coordinate system of three dimensions or more to set values corresponding to the number of dimensions of the emotional map 300 as the emotional data 121.

In the present embodiment, as illustrated in a frame 301 of FIG. 9, the size of initial values of the emotional map 300 is such that the maximum value is 100 and the minimum value is −100 as both the X value and the Y value. Then, each time the number of pseudo growth days of the robot 200 increases by one day during a first period, both the maximum value and the minimum value of the emotional map 300 increase by two, respectively. Here, the first period is a period in which the robot 200 pseudo-grows, which is, for example, a period of 50 days after the pseudo birth of the robot 200. Note that the pseudo birth of the robot 200 means the first startup time of the robot 200 by the user after factory shipment. When the number of growth days becomes 25 days, the maximum value becomes 150 and the minimum value becomes −150 as both the X value and the Y value as illustrated in a frame 302 of FIG. 9. Then, when the first period (50 days in this example) has elapsed, the maximum value becomes 200 and the minimum value becomes −200 as both the X value and the Y value as illustrated in a frame 303 of FIG. 9 as the pseudo growth of the robot 200 is completed, and hence the size of the emotional map 300 is fixed.

A settable range of the emotional data 121 is defined by the emotional map 300. Therefore, as the size of the emotional map 300 increases, the settable range of the emotional data 121 increases. Since richer emotional expression is possible by increasing the settable range of the emotional data 121, the pseudo growth of the robot 200 is expressed by an increase in the size of the emotional map 300. Then, the size of the emotional map 300 is fixed after the lapse of the first period, and then the pseudo growth of the robot 200 is completed. Note that the condition to stop the pseudo growth of the robot 200 is not limited to the "stop after the lapse of the first period" described above, and any other condition may be added. For example, such a condition as to "stop when any one of four personality values becomes 10 (maximum)" may be added. When the pseudo growth of the robot 200 is stopped under this condition, since the personality is fixed at the time when only one personality among the four personalities becomes maximum, a specific personality can be strongly emphasized.

The emotional change data 122 are data that set the amount of change to increase or decrease each of the X value and the Y value of the emotional data 121. In the present embodiment, there are DXP to increase the X value and DXM to decrease the X value as the emotional change data 122 corresponding to the X value of the emotional data 121, and there are DYP to increase the Y value and DYM to decrease the Y value as the emotional change data 122 corresponding to the Y value of the emotional data 121. In other words, the emotional change data 122 are data consisting of the following four variables to indicate a degree of change in the pseudo emotion of the robot 200.

DXP: Ease of security (ease of change in a positive direction of the X value on the emotional map)

DXM: Ease of getting anxious (ease of change in a negative direction of the X value on the emotional map)

DYP: Ease of excitement (ease of change in the positive direction of the Y value on the emotional map)

DYM: Ease of being lethargic (ease of change in the negative direction of the Y value on the emotional map)

In the present embodiment, as an example, it is assumed that the initial values of these variables are all set to 10, and increase up to 20 by a process of learning the emotional change data in behavior control processing to be described later. In this learning process, the emotional change data are changed according to a condition based on whether or not each value of the emotional data reaches the maximum value or the minimum value of the emotional map 300 (a first condition based on external stimulus data). Note that the first condition based on the external stimulus data is not limited to the above condition, and any other condition is settable as long as it is a condition to change (learn) the emotional change data before the size of the emotional map 300 is fixed (for example, a condition related to the degree of each pseudo emotion of the robot 200 represented by the emotional data 121). Since the emotional change data 122, that is, the degree of emotional change changes by this learning process, the robot 200 has various personalities depending on how the user treats the robot 200. In other words, the personality of the robot 200 is formed in an individually different manner depending on how the user treats the robot 200.

Figure 10:
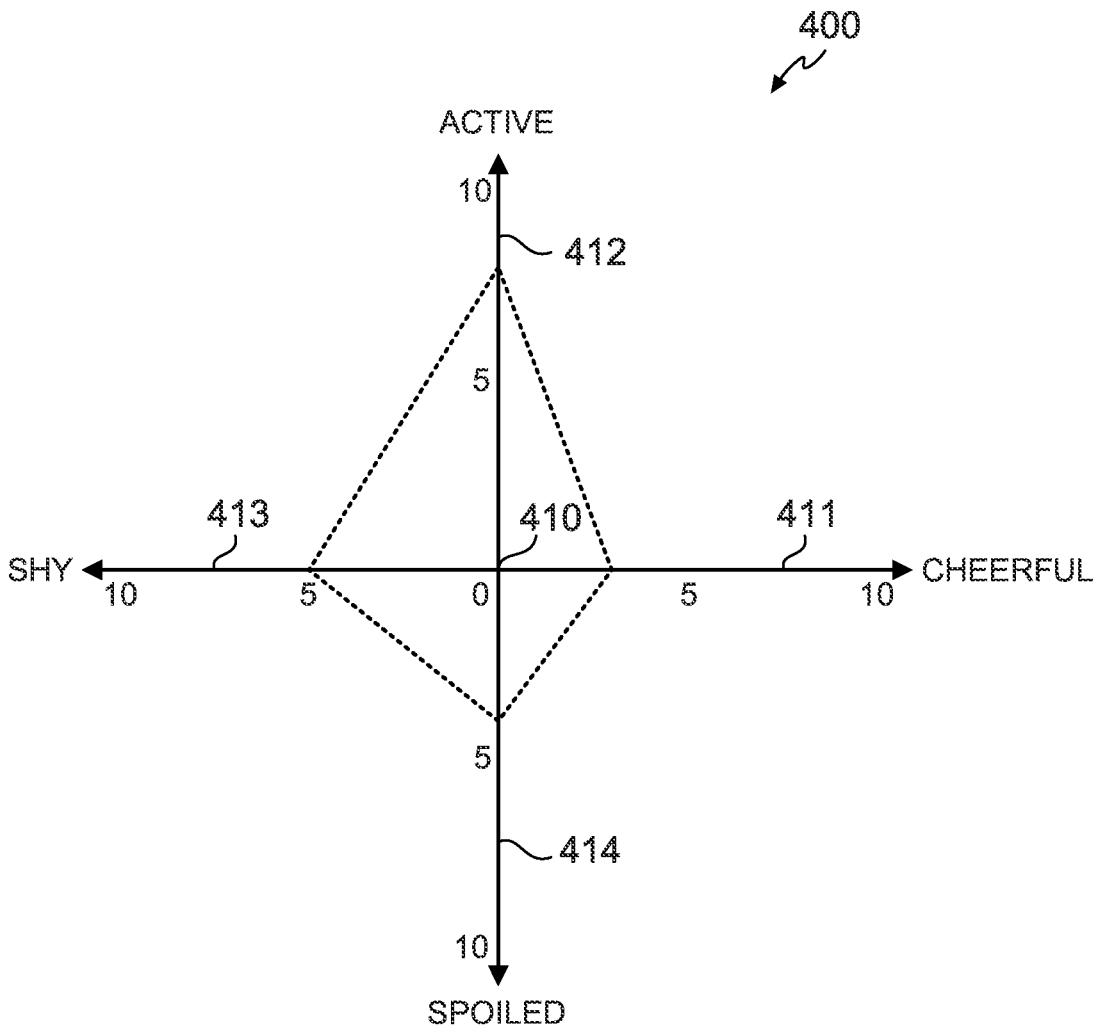
FIG. 10 is a diagram for describing an example of a radar chart of personality values according to the embodiment.

Therefore, in the present embodiment, 10 is subtracted from each emotional change data 122 to derive each personality data (personality value). In other words, a value obtained by subtracting 10 from DXP indicative of ease of security is set as a personality value (Cheerful), a value obtained by subtracting 10 from DXM indicative of ease of getting anxious is set as a personality value (Shy), a value obtained by subtracting 10 from DYP indicative of ease of excitement is set as a personality value (Active), and a value obtained by subtracting 10 from DYM indicative of ease of being lethargic is set as a personality value (Spoiled). Thus, for example, as illustrated in FIG. 10, a personality value radar chart 400 can be generated by plotting the personality value (Cheerful) on an axis 411, the personality value (Active) on an axis 412, the personality value (Shy) on an axis 413, and the personality value (Spoiled) on an axis 414, respectively.

Since the initial value of each personality value is 0, the first personality of the robot 200 is represented at an origin 410 of the personality value radar chart 400. Then, as the robot 200 grows, each personality value changes up to 10 depending on the external stimulus or the like detected by the sensor unit 210 (depending on how the user treats the robot 200). When the four personality values change from 0 up to 10 as in the present embodiment, personalities of 11 to the fourth power=14641 personalities can be expressed.

In the present embodiment, the largest value among these four personality values is used as growth degree data (growth value) indicative of the degree of pseudo growth of the robot 200. Then, the processing unit 110 performs control so that variations occur in the behavioral content of the robot 200 as the robot 200 pseudo-grows (as the growth value increases). Therefore, data used by the processing unit 110 are the growth table 123.

As illustrated in FIG. 11, the types of behaviors produced by the robot 200 according to behavioral triggers such as external stimuli or the like detected by the sensor unit 210, and the probability with which each behavior is selected according to the growth value (hereinafter called the "behavior selection probability") are recorded in the growth table 123. Then, a basic behavior set according to each behavioral trigger is selected regardless of the personality value while the growth value is small, and as the growth value increases, a behavior selection probability is so set that a personality behavior set according to the personality value is selected. Further, as the growth value increases, the behavior selection probability is set to increase the types of basic behaviors to be selected. In FIG. 11, although the personality behavior selected for each behavioral trigger is one, the type of personality behavior to be selected may increase according to an increase in personality value like in the case of the basic behavior.

For example, as illustrated in FIG. 10, it is assumed that the personality value (Cheerful) is 3, the personality value (Active) is 8, the personality value (shy) is 5, and the personality value (Spoiled) is 4 as the current personality values of the robot 200, and a loud sound is detected with the microphone 213. In this case, the growth value becomes 8 as the maximum value among the four personality values, and the behavioral trigger is that "THERE IS LOUD SOUND." Then, referring to an item in which the growth value is 8 in connection with the behavioral trigger indicating that "THERE IS LOUD SOUND" in the growth table 123 illustrated in FIG. 11, it is found that the behavior selection probabilities are as follows: "BASIC BEHAVIOR 2-0" is 20%, "BASIC BEHAVIOR 2-1" is 20%, "BASIC BEHAVIOR 2-2" is 40%, and "PERSONALITY BEHAVIOR 2-0" is 20%.

In other words, in this case, respective behaviors are selected with the following probabilities: "BASIC BEHAVIOR 2-0" is 20%, "BASIC BEHAVIOR 2-1" is 20%, "BASIC BEHAVIOR 2-2" is 40%, and "PERSONALITY BEHAVIOR 2-0" is 20%. Then, when "PERSONALITY BEHAVIOR 2-0" is selected, any one of four types of personality behaviors is further selected according to the four personality values as illustrated in FIG. 12. Then, the robot 200 executes a behavior selected here. This mechanism is realized in behavior control processing to be described later. Note that an operating mode in which a behavior is selected from among personality behaviors is called a first operating mode, and an operating mode in which a behavior is selected from basic behaviors is called a second operating mode.

As will be described later, since each personality behavior is selected with a probability according to the magnitude of each of the four personality values, respectively, there are few variations in selection while the personality values are small (for example, mostly 0). Therefore, in the present embodiment, the maximum value among the four personality values is set as the growth value. This has such an effect that the first operating mode is selected when there are many behavioral variations to be selected as personality behaviors. In addition to the maximum value, since the total value and the average value of the personality values, the most frequent value, and the like can be used as indexes of determining whether or not there are many behavioral variations to be selected according to the personality values, the total value and the average value of the personality values, the most frequent value, and the like may also be used as growth values.

Note that the form of the growth table 123 is optional as long as it can be defined as a function (growth function) to return a behavior selection probability of each behavior type for each behavioral trigger using each growth value as an argument, and the growth table 123 does not necessarily have to be tabular data as illustrated in FIG. 11.

As illustrated in FIG. 12, the behavioral content table 124 is a table in which a specific behavioral content of each behavior type defied in the growth table 123 is recorded, respectively. However, as for the personality behavior, a behavioral content is defined for each type of personality. Note that the behavioral content table 124 is not required data. For example, when the growth table 123 is configured in such a form that a specific behavioral content is recorded directly in each item of behavior type in the growth table 123, the behavioral content table 124 is unnecessary.

As illustrated in FIG. 13, the motion table 125 is a table to record how the processing unit 110 controls the twist motor 221 and the vertical motor 222 for each behavior type defined in the growth table 123. Specifically, as illustrated in FIG. 13, the operating time (milliseconds), the operating angle of the twist motor 221 after the operating time, and the operating angle of the vertical motor 222 after the operating time are recorded for each behavior type in respective rows. In the present embodiment, voice data to be output from the speaker 231 for each behavior type is also recorded.

For example, when the basic behavior 2-0 is selected by the behavior control processing to be described later, the processing unit 110 first controls both the twist motor 221 and the vertical motor 222 so that the angles thereof become 0 degrees after 100 milliseconds, and after further 100 milliseconds, controls the angle of the vertical motor 222 to be −24 degrees. Then, during further 700 milliseconds, the processing unit 110 does not rotate both of the motors, and after further 500 milliseconds, the processing unit 110 controls the angle of the twist motor 221 to be 34 degrees and the angle of the vertical motor 222 to remain at −24 degrees. Then, after further 400 milliseconds, the processing unit 110 controls the angle of the twist motor 221 to be −34 degrees, and after further 500 milliseconds, the processing unit 110 controls the angles of both the twist motor 221 and the vertical motor 222 to be 0 degrees, thus completing the operation of the basic behavior 2-0. Further, in parallel with the driving of the twist motor 221 and the vertical motor 222 described above, the processing unit 110 plays back voice data to chirp shortly from the speaker 231.

The initial value of the growth days data 126 is 1, and 1 is added each time a day passes. The pseudo growth days (the number of days after the pseudo-birth) of the robot 200 are represented by the growth days data 126. Here, a period of growth days represented by the growth days data 126 is called a second period.

Referring next to flowcharts of FIG. 14 and FIG. 15, the behavior control processing executed by the processing unit 110 of the equipment control device 100 will be described. The behavior control processing is processing in which the equipment control device 100 controls the drive units of the robot 200 and output of sounds based on the detected values from the sensor unit 210, the battery remaining amount, and the like. When the user turns on the power of the robot 200, the execution of threads of this behavior control processing is started in parallel with other required processes. By the behavior control processing, the drive unit 220 and the output unit 230 (sound output unit) are controlled to represent the movement of the robot 200 and output the sound of barking or singing.

First, the processing unit 110 sets various data such as the emotional data 121, the emotional change data 122, and the growth days data 126 (step S101). At first startup of the robot 200 (at first startup by the user after factory shipment), initial values are set to these values (the initial values of the emotional data 121, the emotional change data 122, and the growth days data 126 are all value 0), and upon second startup or later, values of data stored in step S109 of the last robot control processing to be described later are set. However, the robot 200 may also have such specifications that the values of the emotional data 121 are all initialized to 0 each time the robot 200 is powered on.

Next, the processing unit 110 determines whether or not there is an external stimulus detected by the sensor unit 210 (step S102). When there is an external stimulus (step S102: Yes), the processing unit 110 acquires the external stimulus from the sensor unit 210 (step S103). Then, the processing unit 110 acquires emotional change data 122 to be added to or subtracted from the emotional data 121 according to the external stimulus acquired in step S103 (step S104). Specifically, for example, when such an external stimulus that the head part 204 is rubbed is detected by the touch sensor 211 of the head part 204, since the robot 200 gets a sense of pseudo security, the processing unit 110 acquires DXP as the emotional change data 122 to be added to the X value of the emotional data 121.

Then, the processing unit 110 sets the emotional data 121 according to the emotional change data 122 acquired in step S104 (step S105). Specifically, for example, when DXP is acquired as the emotional change data 122 in step S104, the processing unit 110 adds DXP of the emotional change data 122 to the X value of the emotional data 121. However, when the value (X value, Y value) of the emotional data 121 exceeds the maximum value of the emotional map 300 by adding the emotional change data 122, the value of the emotional data 121 is set to the maximum value of the emotional map 300. Further, when the value of the emotional data 121 is less than the minimum value of the emotional map 300 by subtracting the emotional change data 122, the value of the emotional data 121 is set to the minimum value of the emotional map 300.

Although it can be arbitrarily set what kind of emotional change data 122 is acquired for each of the external stimuli and what kind of emotional data 121 is set in step S104 and step S105, an example is illustrated here as follows: Since the maximum value and the minimum value for the X value and the Y value of the emotional data 121 are defined by the size of the emotional map 300, the maximum value is set when exceeding the maximum value of the emotional map 300 and the minimum value is set when being below the minimum value of the emotional map 300, respectively, by the following calculations.

The head part 204 is rubbed (feels relieved): $X=X+DXP$

The head part 204 is hit (gets anxious): $X=X-DXM$ (These external stimuli are detectable by the touch sensor 211 of the head part 204)

The body part 206 is rubbed (gets excited): $Y=Y+DYP$

The body part 206 is hit (becomes lethargic): $Y=Y-DYM$ (These external stimuli are detectable by the touch sensor 211 of the body part 206)

The robot 200 is hugged with head up (becomes happy): $X=X+DXP$ and $Y=Y+DYP$

The robot 200 is suspended with head down (becomes sad): $X=X-DXM$ and $Y=Y-DYM$ (These external stimuli are detectable by the touch sensor 211 and the acceleration sensor 212)

The robot 200 is called with a gentle voice (becomes calm): $X=X+DXP$ and $Y=Y-DYM$ The robot 200 is yelled (Gets stressed): $X=X-DXM$ and $Y=Y+DYP$ (These external stimuli are detectable by the microphone 213)

For example, when the head part 204 is rubbed, since the pseudo emotion of the robot 200 feels relieved, DXP of the emotional change data 122 is added to the X value of the emotional data 121. Conversely, when the head part 204 is hit, since the pseudo emotion of the robot 200 gets anxious, DXM of the emotional change data 122 is subtracted from the X value of the emotional data 121. In step S103, since the processing unit 110 acquires plural types of external stimuli different from one another from the two or more sensors included in the sensor unit 210, the emotional change data 122 is acquired according to each of these external stimuli, and the emotional data 121 is set according to the acquired emotional change data 122.

Then, the processing unit 110 executes a behavior selection process using information on the external stimulus acquired in step S103 as a behavioral trigger (step S106), and after that, the processing unit 110 proceeds to step S108. Although the details of the behavior selection process will be described later, the behavioral trigger is information on the external stimulus or the like to trigger the robot 200 to perform some behavior.

On the other hand, when there is no external stimulus in step S102 (step S102: No), the processing unit 110 determines whether or not to perform a spontaneous movement such as breathing movement (step S107). The determination method of determining whether or not to perform a spontaneous movement is optional, but in the present embodiment, it is assumed that the determination in step S107 is Yes every first reference time (for example, every 4 seconds).

When the spontaneous movement is performed (step S107: Yes), the processing unit 110 proceeds to step S106 to execute the behavior selection process using the "lapse of the first reference time" as a behavioral trigger, and after that, the processing unit 110 proceeds to step S108.

When the spontaneous movement is not performed (step S107: No), the processing unit 110 proceeds to FIG. 15 in which the processing unit 110 determines whether or not to acquire a remaining amount notification stimulus (step S121). The remaining amount notification stimulus is an external stimulus as a trigger to give a notification of the battery remaining amount. In the present embodiment, it is assumed that the remaining amount notification stimulus is such that "the head part 204 is rubbed while hugging the robot 200 with head up." This external stimulus (remaining amount notification stimulus) can be detected by the acceleration sensor 212 and the touch sensor 211 of the head part 204.

When acquiring the remaining amount notification stimulus (step S121: Yes), the processing unit 110 determines that a notification condition to give a notification of the battery remaining amount is met, and performs a remaining-amount notification operation process to be described later (step S122). Then, the processing unit 110 proceeds to step S123. When not acquiring the remaining amount notification stimulus (step S121: No), the processing unit 110 proceeds to step S123.

In step S123, the processing unit 110 determines whether or not a remaining amount checking time has passed since the execution of a last-time remaining amount checking process. The remaining amount checking time is a time interval to check the battery remaining amount regularly, which is ten minutes in the present embodiment.

When the remaining amount checking time has passed (step S123: Yes), the processing unit 110 performs the remaining amount checking process to be described later (step S124), and the processing unit 110 proceeds to step S125. When the remaining amount checking time has not passed (step S123: No), the processing unit 110 proceeds to step S125.

In step S125, the processing unit 110 determines whether or not to receive a remaining amount notification request from an external smartphone or the like through the communication unit 130. The remaining amount notification request is a request packet to request the robot 200 to transmit battery level information, which is transmitted from the smartphone or the like through wireless LAN or the like.

When receiving the remaining amount notification request (step S125: Yes), the processing unit 110 transmits the battery level information to the device (external smartphone or the like) from which the remaining amount notification request was transmitted (step S126), and the processing unit 110 proceeds to step S127. When not receiving the remaining amount notification request (step S125: No), the processing unit 110 proceeds to step S127.

In step S127, the processing unit 110 determines whether or not a temperature checking time has passed since the execution of a last-time temperature checking process. The temperature checking time is a time interval to check temperature regularly, which is ten minutes in the present embodiment.

When the temperature checking time has passed (step S127: Yes), the processing unit 110 performs the temperature checking process to be described later (step S128), and after that, the processing unit 110 returns to FIG. 14 and proceeds to step S108. When the temperature checking time has not passed (step S127: No), the processing unit 110 returns to FIG. 14 and proceeds to step S108.

In step S108, the processing unit 110 determines whether or not to end the processing. For example, when the operation unit 240 accepts an instruction from the user to power off the robot 200, the processing is ended. When ending the processing (step S108: Yes), the processing unit 110 stores various data such as the emotional data 121, the emotional change data 122, and the growth days data 126 in a nonvolatile memory (for example, a flash memory) of the storage unit 120 (step S109), and ends the behavior control processing. Note that the process of storing various data in the nonvolatile memory when the power is off may also be performed separately in such a manner as to run a power-off determination thread in parallel with any other thread in the behavior control processing or the like. If the processes corresponding to step S108 and step S109 are performed by the power-off determination thread, the processes of step S108 and step S109 in the behavior control processing can be omitted.

When the processing is not to be ended (step S108: No), the processing unit 110 uses a clock function to determine whether or not the date has changed (step S110). When the date has not changed (step S110: No), the processing unit 110 returns to step S102.

When the date has changed (step S110: Yes), the processing unit 110 determines whether or not it is during the first period (step S111). When the first period is set to a period of 50 days after the pseudo-birth of the robot 200 (for example, since the first startup by the user after purchase), the processing unit 110 determines that it is during the first period when the growth days data 126 is 50 or less. When it is not during the first period (step S111: No), the processing unit 110 proceeds to step S115.

When it is during the first period (step S111: Yes), the processing unit 110 learns the emotional change data 122 (step S113). Specifically, in step S105 of the day, the emotional change data 122 is updated by adding 1 to DXP of the emotional change data 122 when the X value of the emotional data 121 is set even once to the maximum value of the emotional map 300, adding 1 to DYP of the emotional change data 122 when the Y value of the emotional data 121 is set even once to the maximum value of the emotional map 300, adding 1 to DXM of the emotional change data 122 when the X value of the emotional data 121 is set even once to the minimum value of the emotional map 300, or adding 1 to DYM of the emotional change data 122 when the Y value of the emotional data 121 is set even once to the minimum value of the emotional map 300. This update is also called learning of the emotional change data 122.

However, when each value of the emotional change data 122 becomes too large, the amount of one-time change in the emotional data 121 becomes too large. Therefore, for example, the maximum value is set to 20, and each value of the emotional change data 122 is limited to 20 or less. Further, 1 is added to any of the emotional change data 122 here, but the value to be added is not limited to 1. For example, the number of times each value of the emotional data 121 is set to the maximum value or the minimum value of the emotional map 300 may be counted, and when the number of times is large, the value to be added to the emotional change data 122 may increase.

The learning of the emotional change data 122 in step S113 is based on whether or not the emotional data 121 is set to the maximum value or the minimum value of the emotional map 300 in step S105. Then, the determination of whether or not the emotional data 121 is set to the maximum value or the minimum value of the emotional map 300 in step S105 is based on the external stimulus acquired in step S103. Then, since plural types of external stimuli different from one another are acquired in step S103 by plural sensors included in the sensor unit 210, each piece of emotional change data 122 is learned according to each of these plural external stimuli.

For example, when only the head part 204 is rubbed many times, only DXP of the emotional change data 122 increases. In this case, since the other pieces of emotional change data 122 do not change, the robot 200 becomes a personality easy to feel relieved. Further, when only the head part 204 is hit many times, only DXM of the emotional change data 122 increases. In this case, since the other pieces of emotional change data 122 do not change, the robot 200 becomes a personality easy to get anxious. Thus, the processing unit 110 learns the emotional change data 122 to make them different from one another according to each of the external stimuli. In the present embodiment, since personality values are calculated from the emotional change data 122 and the maximum value of each personality value becomes a growth value, the effect that the robot 200 pseudo-grows based on how the user treats the robot 200 can be obtained.

Note that, in the present embodiment, the emotional change data 122 is learned when the X value or the Y value of the emotional data 121 reaches the maximum value or the minimum value of the emotional map 300 even once during a period of one day in step S105 of the day. However, the condition for learning the emotional change data 122 is not limited thereto. For example, when the X value or the Y value of the emotional data 121 reaches a predetermined value even once (for example, a value 0.5 times the maximum value of the emotional map 300 or a value 0.5 times the minimum value of the emotional map 300), the emotional change data 122 may be learned. Further, the period is not limited to the one-day period of the day, and when the X value or the Y value of the emotional data 121 reaches a predetermined value even once during another period such as half a day or one week, the emotional change data 122 may be learned. Further, when the X value or the Y value of the emotional data 121 reaches a predetermined value even once during a period until the number of acquisitions of external stimuli reaches a predetermined number of times (for example, 50 times), rather than the certain period such as one day, the emotional change data 122 may be learned.

Returning to FIG. 14, the processing unit 110 enlarges the emotional map 300 to increase both the maximum value and the minimum value by 2 (step S114). Note that the emotional map 300 is enlarged to increase both the maximum value and the minimum value by 2 here, but the value "2" by which the maximum value and the minimum value are increased is just an example, and the maximum value and the minimum value may be increased by 3 or more, or increased by 1. Further, the value by which the maximum value and the minimum value are increased may be different between the respective axes of the emotional map 300 or between the maximum value and the minimum value. Then, the processing unit 110 adds 1 to the growth days data 126 to initialize both the X value and the Y value of the emotional data to 0 (step S115), and returns to step S102.

Figure 14:
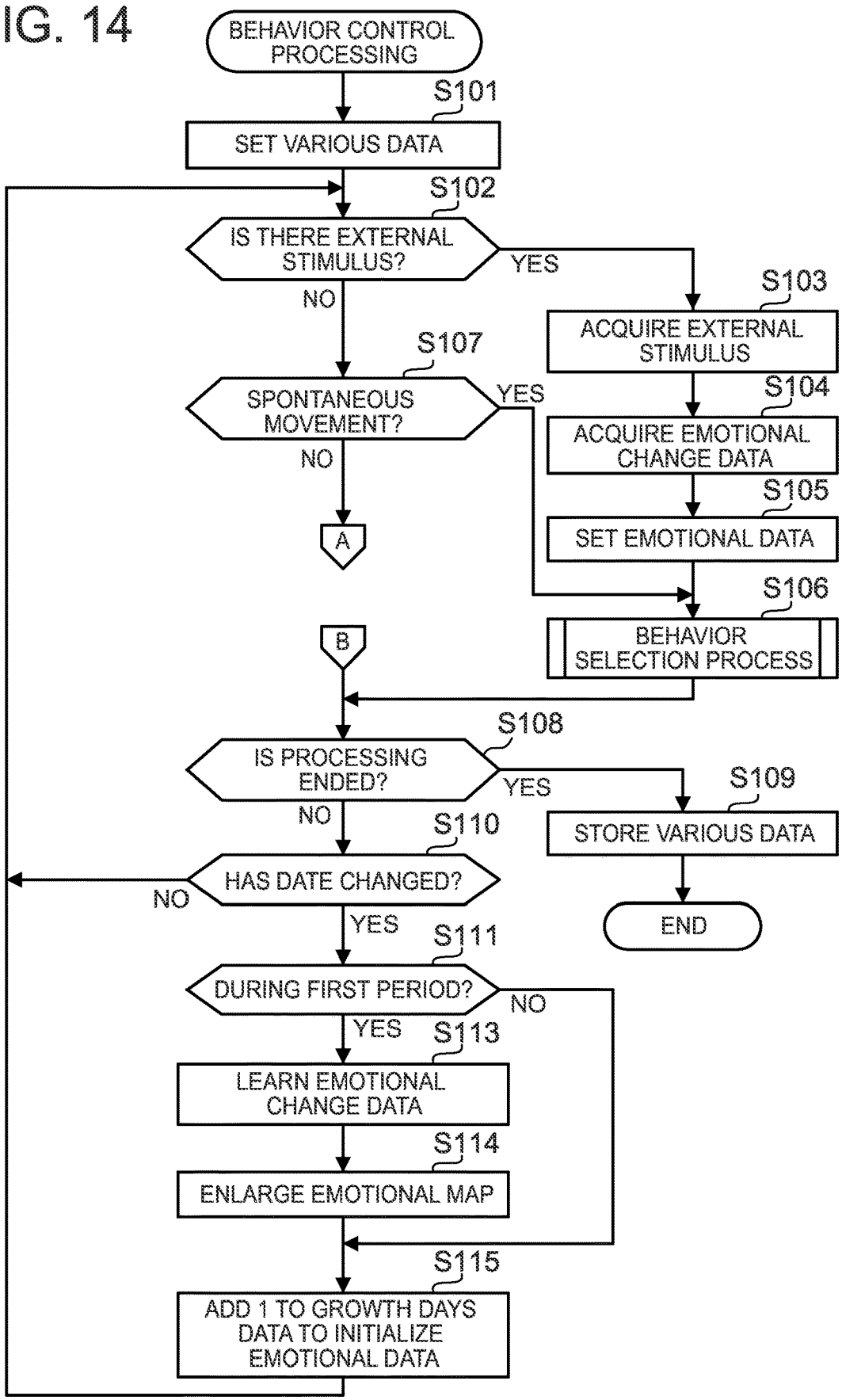
FIG. 14 is a first part of a flowchart of behavior control processing according to the embodiment.
Figure 15:
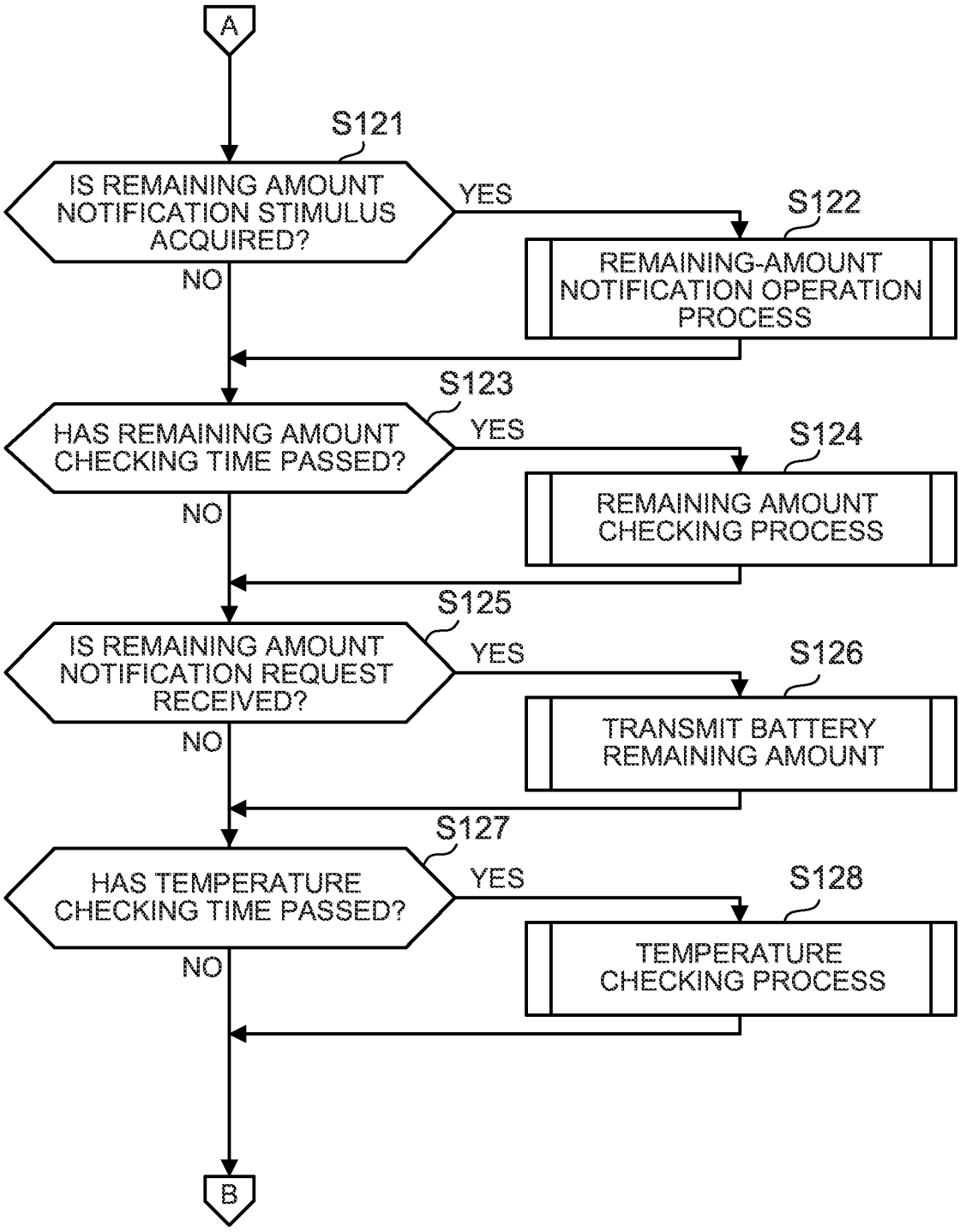
FIG. 15 is a second part of the flowchart of the behavior control processing according to the embodiment.

In FIG. 14, although the learning of the emotional change data and the enlargement of the emotional map are performed after determining that the date has changed in step S110, they may also be performed after determining that it is a reference time (for example, 9:00 pm). Further, the determination in step S110 may be made based on a value obtained by accumulating the power-on time of the robot 200 by the timer function of the processing unit 110, rather than that the determination is made by the actual date. For example, the robot 200 may be considered to grow up for a day each time the cumulative power-on time becomes a time in multiples of 24 so as to perform the learning of the emotional change data and the enlargement of the emotional map. Further, in consideration of a user who tends to leave the robot 200 alone (to slow down the growth of the robot 200 when being left alone), the determination may be made based on the number of inputs of external stimuli (for example, the robot 200 is considered to grow up for a day each time the number of inputs becomes 100 times.

Figure 16:
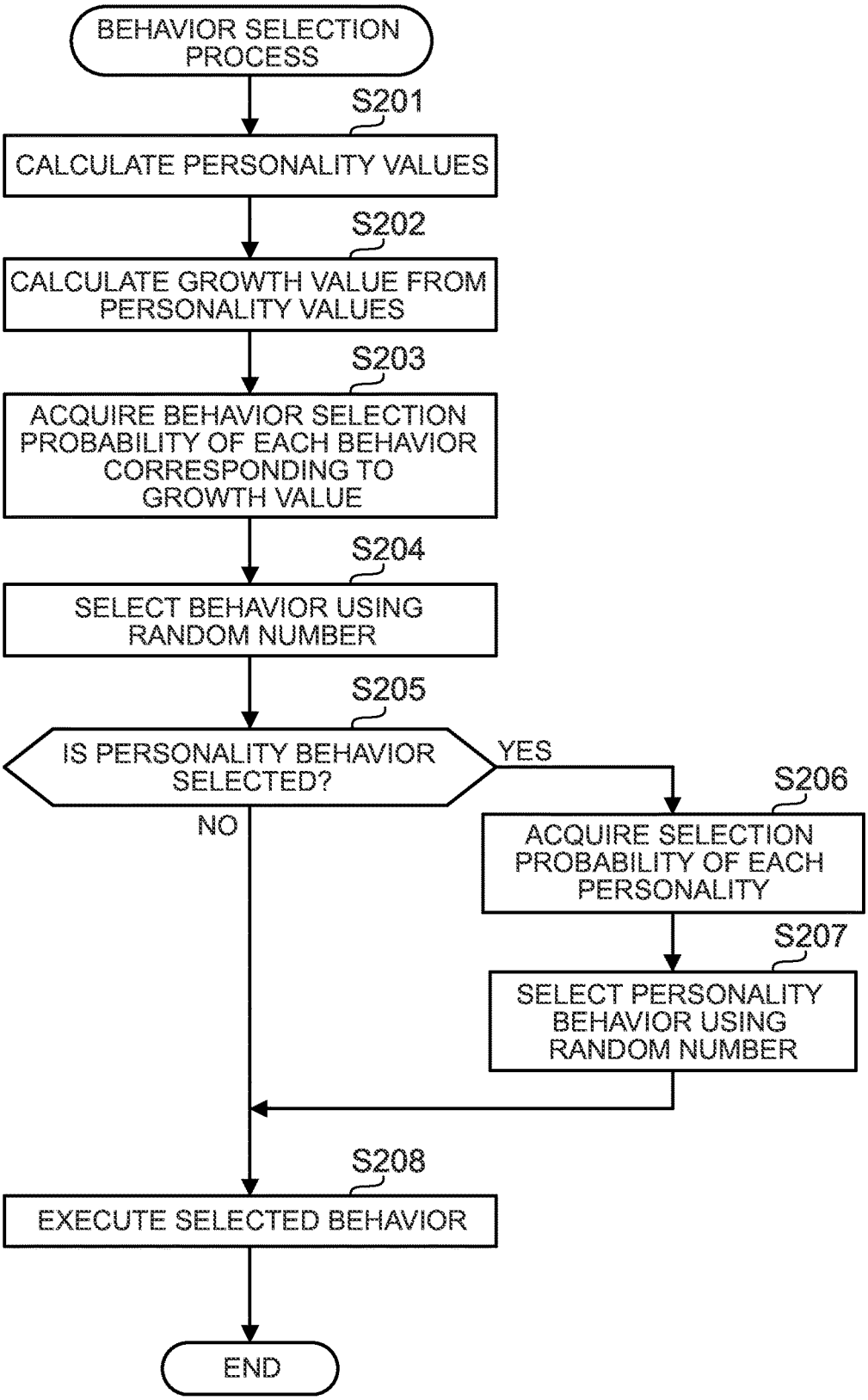
FIG. 16 is a flowchart of a behavior selection process according to the embodiment.

Referring next to FIG. 16, the behavior selection process executed in step S106 of the behavior control processing described above will be described.

First, based on the emotional change data 122 learned in step S113, the processing unit 110 calculates personality values (step S201). Specifically, four personality values are calculated as below. Since each piece of emotional change data 122 is 10 as the initial value and increases up to 20, the value is in a range of not less than 0 and not more than 10 by subtracting 10 from the value here.

Personality value (Cheerful)=*DXP*−10

Personality value (Shy)=*DXM*−10

Personality value (Active)=*DYP*−10

Personality value (Spoiled)=*DYM*−10

Next, the processing unit 110 calculates, as a growth value, the largest value among these personality values (step S202). Then, the processing unit 110 refers to the growth table 123 to acquire the behavior selection probability of each behavior type corresponding to a behavioral trigger given when the behavior selection process is executed and the growth value calculated in step S202 (step S203).

Next, based on the behavior selection probability of each behavior type acquired in step S203, the processing unit 110 selects a behavior type using a random number (step S204). For example, when the calculated growth value is 8 and the behavioral trigger is that "there is a loud sound," "basic behavior 2-0" is selected with a probability of 20%, "basic behavior 2-1" is selected with a probability of 20%, "basic behavior 2-2" is selected with a probability of 40%, and "personality behavior 2-0" is selected with a probability of 20% (see FIG. 11).

Then, the processing unit 110 determines whether or not the personality behavior is selected in step S204 (step S205). When the personality behavior is not selected, that is, when any basic behavior is selected (step S205: No), the processing unit 110 proceeds to step S208.

When the personality behavior is selected (step S205: Yes), the processing unit 110 acquires the selection probability of each personality based on the magnitude of each personality value (step S206). Specifically, a value obtained by dividing a personality value corresponding to each personality by a total value of the four personality values is set as the selection probability.

Then, based on the selection probability of each personality acquired in step S206, the processing unit 110 selects a personality behavior using a random number (step S207). For example, when the personality value (Cheerful) is 3, the personality value (Active) is 8, the personality value (Shy) is 5, and the personality value (Spoiled) is 4, the total value of them is 3+8+5+4=20. Therefore, in this case, the personality behavior of "Cheerful" is selected with a probability of 3/20=15%, the personality behavior of "Active" is selected with a probability of 8/20=40%, the personality behavior of "Shy" is selected with a probability of 5/20=25%, and the personality behavior of "Spoiled" is selected with a probability of 4/20=20%, respectively.

Next, the processing unit 110 executes a behavior selected in step S204 or S207 (step S208), ends the behavior selection process, and proceeds to step S108 of the behavior control processing.

Figure 17:
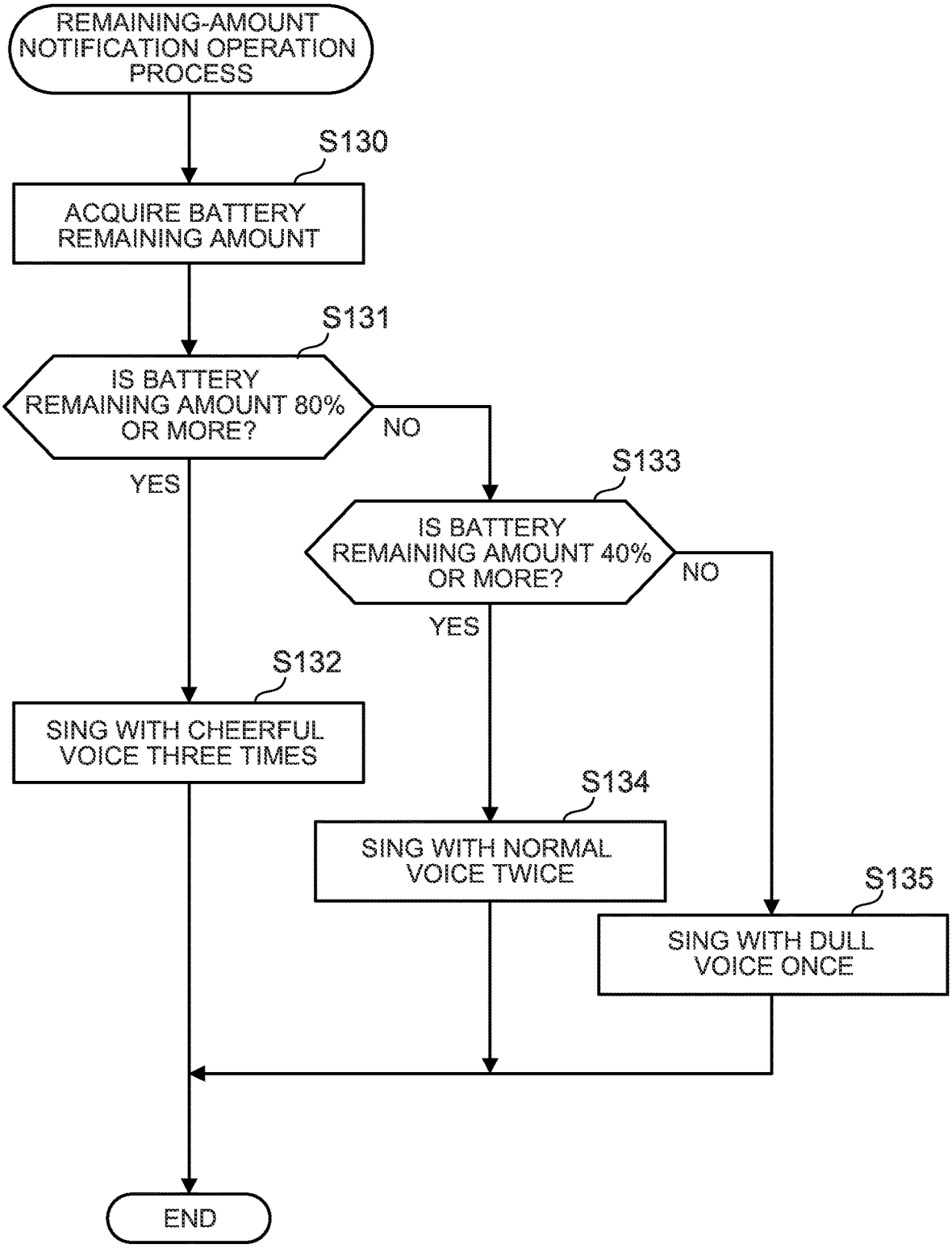
FIG. 17 is a flowchart of a remaining-amount notification operation process according to the embodiment.

Referring next to FIG. 17, the remaining-amount notification operation process executed in step S122 of the behavior control processing described above will be described.

First, the processing unit 110 acquires the battery remaining amount from the power control unit 250 (step S130). Then, the processing unit 110 determines whether the acquired battery remaining amount is a first remaining-amount notification threshold value (for example, 80%) or more (step S131). When the battery remaining amount is the first remaining-amount notification threshold value or more (step S131: Yes), the processing unit 110 executes a first notification operation as an operation to indicate that the battery remaining amount is the first remaining-amount notification threshold value or more (for example, the battery remaining amount is still enough) (step S132). Although the kind of the first notification operation is optional, the first notification operation in the present embodiment is such an operation as to sing with a cheerful voice three times. Specifically, the processing unit 110 outputs voice data of the robot 200 singing with a cheerful voice three times from the speaker 231 while controlling the drive unit 220 to move the head part 204 cheerfully. Then, the processing unit 110 ends the remaining-amount notification operation process and proceeds to step S123 of the behavior control processing.

When the battery remaining amount is less than the first remaining-amount notification threshold value (step S131: No), the processing unit 110 determines whether the battery remaining amount is a second remaining-amount notification threshold value (for example, 40%) or more (step S133). When the battery remaining amount is the second remaining-amount notification threshold value or more (step S133: Yes), the processing unit 110 executes a second notification operation as an operation to indicate that the battery remaining amount is less than the first remaining-amount notification threshold value and the second remaining-amount notification threshold value or more (for example, the battery remaining amount is about half) (step S134). Although the kind of the second notification operation is optional, the second notification operation in the present embodiment is such an operation as to sing with a normal voice twice. Specifically, the processing unit 110 outputs voice data of the robot 200 singing with a normal voice twice from the speaker 231 while controlling the drive unit 220 to move the head part 204 normally. Then, the processing unit 110 ends the remaining-amount notification operation process and proceeds to step S123 of the behavior control processing.

When the battery remaining amount is less than the second remaining-amount notification threshold value (step S133: No), the processing unit 110 executes a third notification operation as an operation to indicate that the battery remaining amount is less than the second remaining-amount notification threshold value (for example, the battery remaining amount is less than half) (step S135). Although the kind of the third notification operation is optional, the third notification operation in the present embodiment is such an operation as to sing with a dull voice once. Specifically, the processing unit 110 outputs voice data of the robot 200 singing with a dull voice once from the speaker 231 while controlling the drive unit 220 to move the head part 204 in a dull state. Then, the processing unit 110 ends the remaining-amount notification operation process and proceeds to step S123 of the behavior control processing.

When a remaining amount notification stimulus (for example, the head is rubbed while being hugged) is detected, the processing unit 110 changes the control mode of controlling the drive unit 220 and the output unit 230 (sound output unit) by the remaining-amount notification operation process described above to a control mode of outputting a singing voice while moving the head part 204 according to the battery remaining amount. Therefore, when wanting to know the battery remaining amount, the user can know the battery remaining amount by the reaction of the robot 200 when giving the remaining amount notification stimulus to the robot 200 (for example, to rub the head while hugging the robot 200). As the remaining amount notification stimulus, since an operation to treat a pet with affection can be set, the robot 200 can let the user know the battery remaining amount without losing the sense of a creature. Further, since the number of times the robot 200 sings a song is reduced and the energy of singing voice is reduced as the battery remaining amount decreases, the robot 200 can let the user know a degree of need to charge the battery without losing the sense of a creature.

Note that the pieces of voice data of the robot 200 singing as described above are pre-generated as sampling data of singing voices of the robot 200, and stored in the storage unit 120. Further, the voice data to be output, the way of moving the head part 204, and the notification operation itself may be changed according to the personality of the robot 200 (for example, the personality corresponding to the largest value among the personality values).

Figure 18:
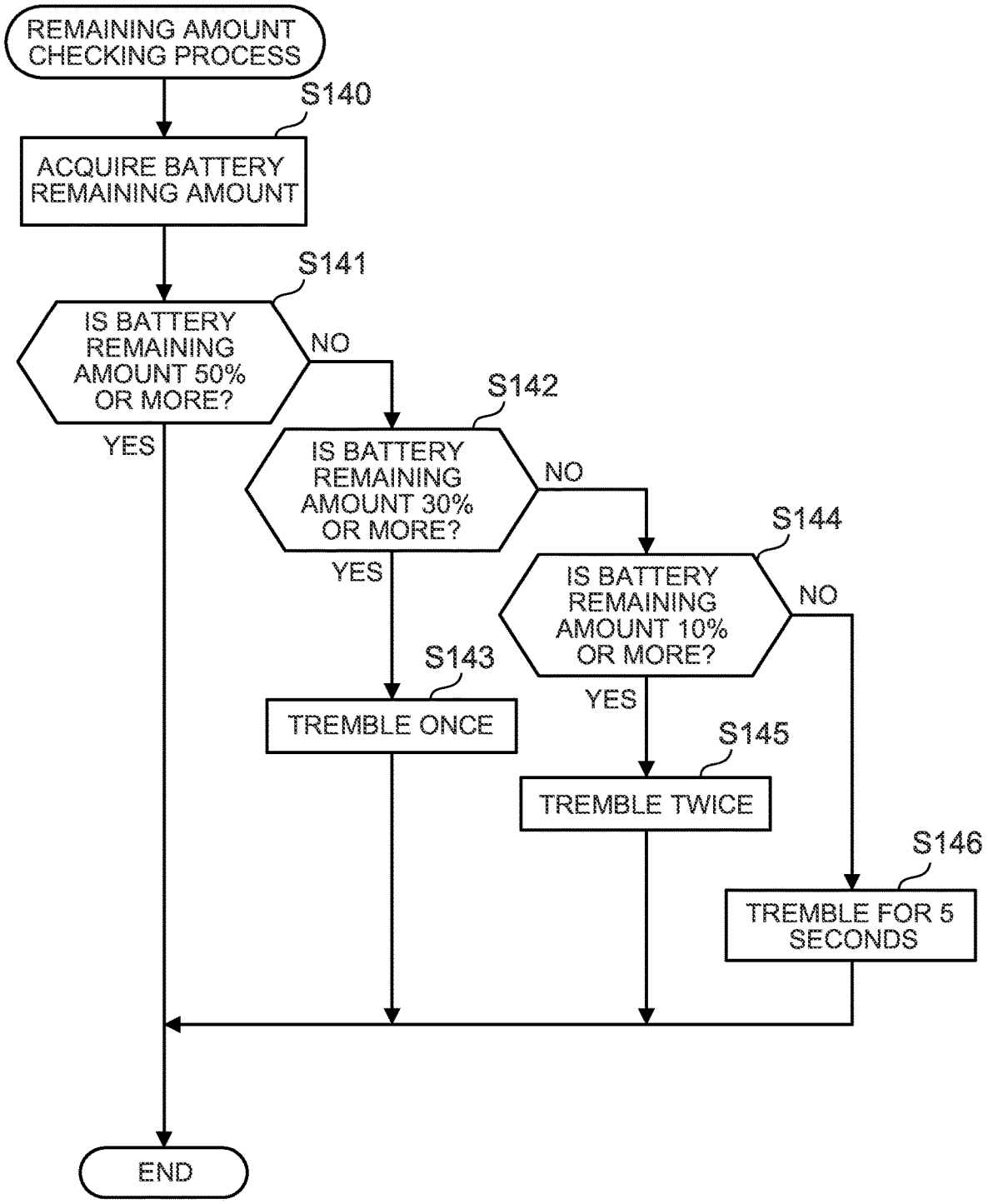
FIG. 18 is a flowchart of a remaining amount checking process according to the embodiment.

Referring next to FIG. 18, the remaining amount checking process executed in step S124 of the behavior control processing described above will be described.

First, the processing unit 110 acquires the battery remaining amount from the power control unit 250 (step S140). Then, the processing unit 110 determines whether the battery remaining amount is a first remaining-amount threshold value (for example, 50%) or more (step S141). When the battery remaining amount is the first remaining-amount threshold value or more (step S141: Yes), the processing unit 110 ends the remaining amount checking process and proceeds to step S125 of the behavior control processing.

When the battery remaining amount is less than the first remaining-amount threshold value (step S141: No), the processing unit 110 determines that a notification condition for giving a notification of the battery remaining amount is met, and determines whether the battery remaining amount is a second remaining-amount threshold value (for example, 30%) or more (step S142). When the battery remaining amount is the second remaining-amount threshold value or more (step S142: Yes), the processing unit 110 executes a first spontaneous notification operation as an operation to spontaneously indicate that the battery remaining amount is less than the first remaining-amount threshold value and the second remaining-amount threshold value or more (for example, the battery remaining amount is less than half) (step S143). Although the kind of the first spontaneous notification operation is optional, the first spontaneous notification operation in the present embodiment is such an operation that the robot 200 trembles for 2 seconds. Specifically, the processing unit 110 executes a vibration operation process to be described later once by setting the number of vibrations, N, to the number of times corresponding to 2 seconds (for example, 20 times). Then, the processing unit 110 ends the remaining amount checking process and proceeds to step S125 of the behavior control processing.

When the battery remaining amount is less than the second remaining-amount threshold value (step S142: No), the processing unit 110 determines whether the battery remaining amount is a third remaining-amount threshold value (for example, 10%) or more (step S144). When the battery remaining amount is the third remaining-amount threshold value or more (step S144: Yes), the processing unit 110 executes a second spontaneous notification operation as an operation to spontaneously indicate that the battery remaining amount is less than the second remaining-amount threshold value and the third remaining-amount threshold value or more (for example, the battery remaining amount considerably decreases) (step S145). Although the kind of the second spontaneous notification operation is optional, the second spontaneous notification operation in the present embodiment is such an operation that the robot 200 repeats the motion of trembling for 2 seconds twice. Specifically, the processing unit 110 executes the vibration operation process to be described later twice at an interval of about 0.5 seconds by setting the number of vibrations, N, to the number of times corresponding to 2 seconds (for example, 20 times). Then, the processing unit 110 ends the remaining amount checking process and proceeds to step S125 of the behavior control processing.

When the battery remaining amount is less than the third remaining-amount threshold value (step S144: No), the processing unit 110 executes a third spontaneous notification operation as an operation to spontaneously indicate that the battery remaining amount is less than the third remaining-amount threshold value (for example, there is almost no battery remaining amount) (step S146). Although the kind of the third spontaneous notification operation is optional, the third spontaneous notification operation in the present embodiment is such an operation that the robot 200 trembles for 5 seconds. Specifically, the processing unit 110 executes the vibration operation process to be described later once by setting the number of vibrations, N, to the number of times corresponding to 5 seconds (for example, 50 times). Then, the processing unit 110 ends the remaining amount checking process and proceeds to step S125 of the behavior control processing.

The processing unit 110 changes the control mode of controlling the drive unit 220 and the output unit 230 (sound output unit) by the remaining-amount notification operation process described above to a control mode of driving the movable parts to cause the robot 200 to vibrate based on the battery remaining amount. Therefore, when the battery remaining amount is less than the first remaining-amount threshold value, the processing unit 110 shakes the body of the robot 200 by the spontaneous notification operation described above to be able to let the user know that the robot 200 wants the user to charge the battery. Even a real pet sometimes shakes its body when it is sick, and the robot 200 shakes its body to be able to let the user know that the robot 200 is sick, that is, the robot 20 needs to be charged. Thus, the robot 200 can let the user know that the robot 200 needs to be charged without losing the sense of a creature. Further, since the number of times the robot 200 shakes its body increases or the time to vibrate the robot 200 is prolonged as the battery remaining amount becomes lower, the robot 200 can let the user know a degree of necessity to charge the battery without losing the sense of a creature.

Note that the spontaneous notification operation may be changed according to the personality of the robot 200 (for example, the personality corresponding to the largest value among the personality values). For example, as the third spontaneous notification operation to indicate that there is almost no battery remaining amount, the processing unit 110 may also perform control to output a sound according to the personality in addition to the control to shake its body. As an example in this case, for example, it is considered that the processing unit 110 outputs "sneezing sound" when the personality corresponding to the largest value among the personality values is "Cheerful," outputs "roaring sound" when it is "Active," outputs no voice (no sound) when it is "Shy," and outputs "sweet singing sound" when it is "Spoiled." Thus, the sense of a creature can further be expressed by performing a spontaneous notification operation according to the personality.

Note that, like the singing voices of the robot 200 described above, the sneezing sound, the roaring sound, the sweet singing sound, and the like are pre-generated as sound sampling data and stored in the storage unit 120.

Figure 19:
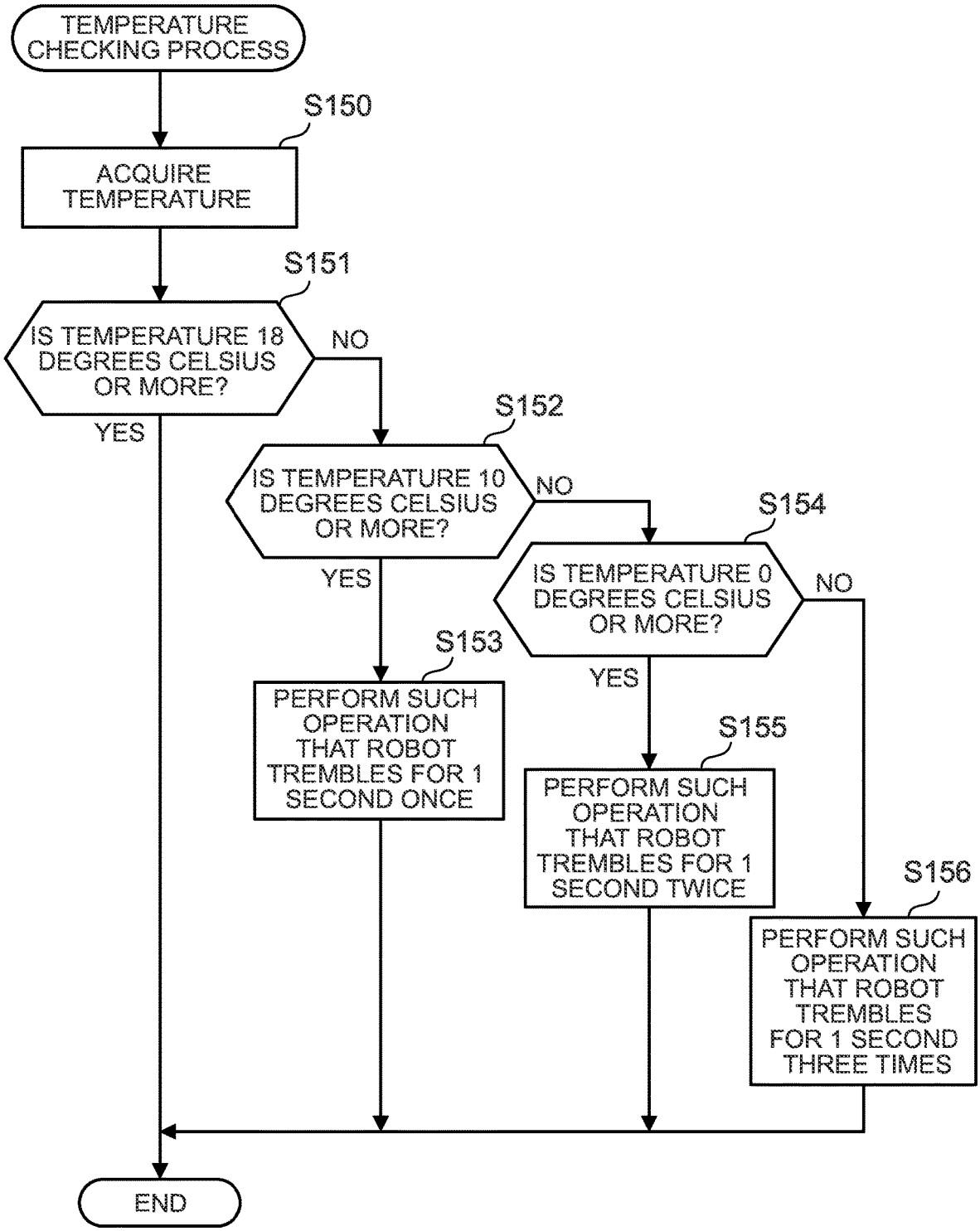
FIG. 19 is a flowchart of a temperature checking process according to the embodiment.

Referring next to FIG. 19, a temperature checking process executed in step S128 of the behavior control processing described above will be described.

First, the processing unit 110 acquires temperature from the temperature sensor 215 (step S150). Then, the processing unit 110 determines whether the temperature is a first temperature threshold value (for example, 18 degrees Celsius) or more (step S151). When the temperature is the first temperature threshold value or more (step S151: Yes), the processing unit 110 ends the temperature checking process and proceeds to step S108 of the behavior control processing.

When the temperature is less than the first temperature threshold value (step S151: No), the processing unit 110 determines that a temperature notification condition is met, and then determines whether the temperature is a second temperature threshold value (for example, 10 degrees Celsius) or more (step S152). When the temperature is the second temperature threshold value or more (step S152: Yes), the processing unit 110 executes a first temperature notification operation as an operation to indicate that the temperature is less than the first temperature threshold value and the second temperature threshold value or more (for example, a little cold) (step S153). Although the kind of the first temperature notification operation is optional, the first temperature notification operation in the present embodiment is such an operation that the robot 200 trembles for 1 second once. Specifically, the processing unit 110 executes a vibration operation process to be described later by setting the number of vibrations, N, to the number of times corresponding to 1 second (for example, 10 times). Then, the processing unit 110 ends the temperature checking process and proceeds to step S108 of the behavior control processing.

When the temperature is less than the second temperature threshold value (step S152: No), the processing unit 110 determines whether the temperature is a third temperature threshold value (for example, 0 degrees Celsius) or more (step S154). When the temperature is the third temperature threshold value or more (step S154: Yes), the processing unit 110 executes a second temperature notification operation as an operation to indicate that the temperature is less than the second temperature threshold value and the third temperature threshold value or more (for example, quite cold) (step S155). Although the kind of the second temperature notification operation is optional, the second temperature notification operation in the present embodiment is such an operation that the robot 200 repeats the motion of trembling for 1 second twice. Specifically, the processing unit 110 executes the vibration operation process to be described later twice at an interval of about 0.5 seconds by setting the number of vibrations, N, to the number of times corresponding to 1 second (for example, 10 times). Then, the processing unit 110 ends the temperature checking process and proceeds to step S108 of the behavior control processing.

When the temperature is less than the third temperature threshold value (step S154: No), the processing unit 110 executes a third temperature notification operation as an operation to indicate that the temperature is less than the third temperature threshold value (for example, very cold) (step S156). Although the kind of the third temperature notification operation is optional, the third temperature notification operation in the present embodiment is such an operation that the robot 200 repeats the motion of trembling for 1 second three times. Specifically, the processing unit 110 executes the vibration operation process to be described later three times at intervals of about 0.5 seconds by setting the number of vibrations, N, to the number of times corresponding to 1 second (for example, 10 times). Then, the processing unit 110 ends the temperature checking process and proceeds to step S108 of the behavior control processing.

Since the robot 200 shakes its body by the temperature checking process described above when the temperature gets colder, the user can know that the temperature is low in a natural way, and the robot 200 can be made to look like a real creature.

Figure 20:
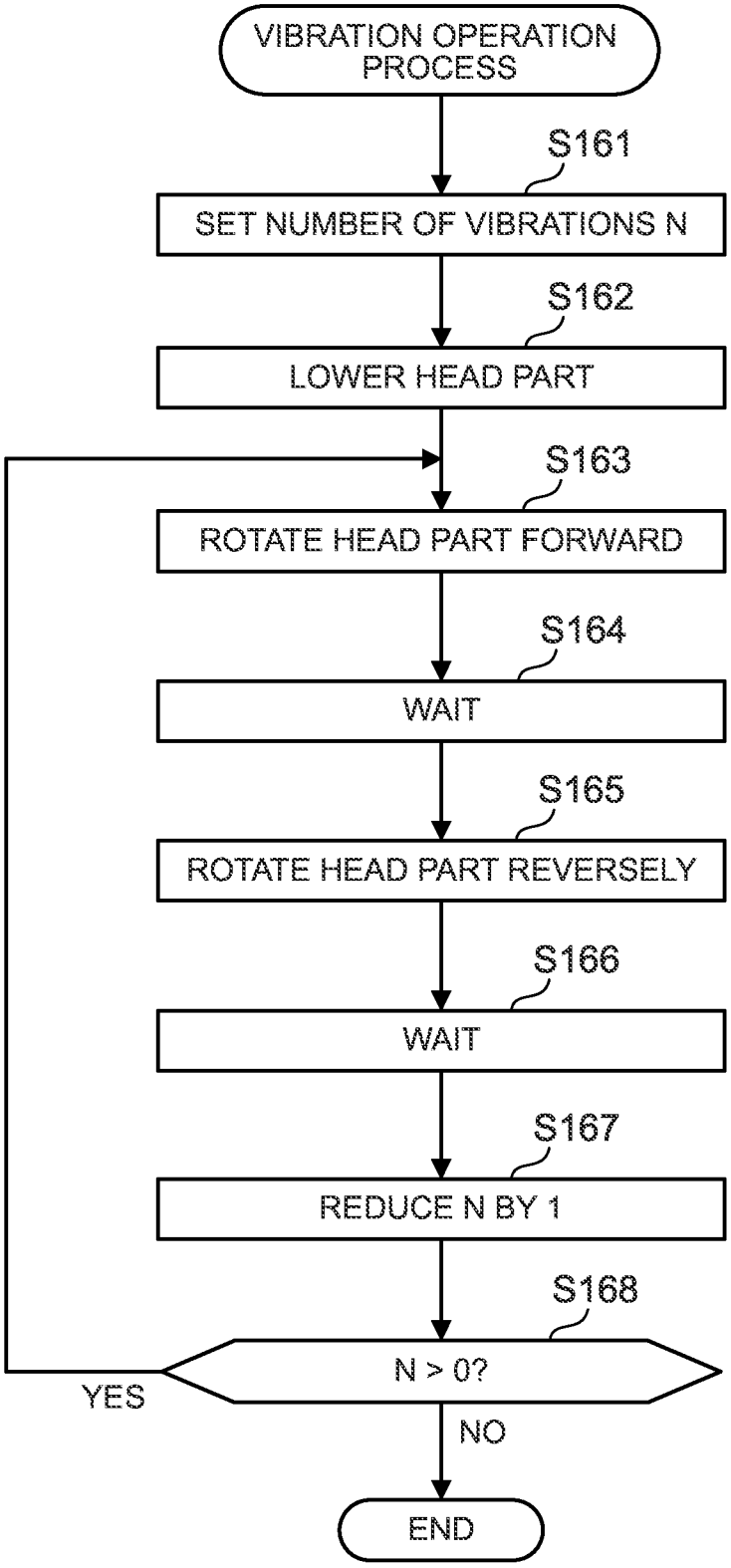
FIG. 20 is a flowchart of a vibration operation process according to the embodiment.

Referring next to FIG. 20, the vibration operation process executed by the processing unit 110 in the remaining amount checking process and the temperature checking process described above to shake the body of the robot 200 will be described.

Figure 21:
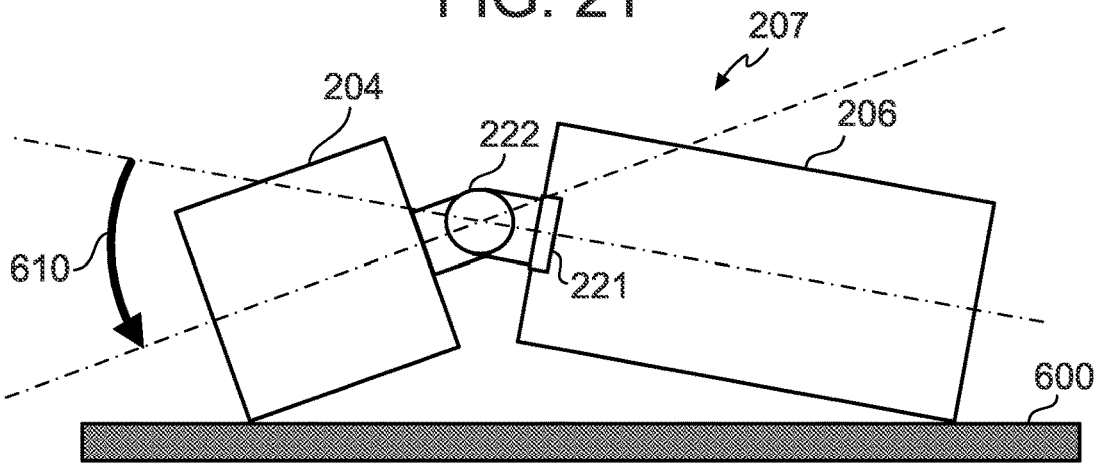
FIG. 21 is a diagram for describing an example of lowering a head part of the robot according to the embodiment.

First, the processing unit 110 sets the number of vibrations, N (step S161). Then, as illustrated in FIG. 21, the processing unit 110 instructs the vertical motor 222 of the drive unit 220 to rotate the head part 204 downward by a preparation angle 610 to lower the head part 204 (step S162). The preparation angle 610 is an angle of not less than 20 degrees and not more than 60 degrees (for example, 30 degrees). Control performed by the processing unit 110 to cause the vertical motor 222 to rotate by the preparation angle 610 is called preparation control. As illustrated in FIG. 21, when the processing unit 110 performs the preparation control, the robot 200 takes such a posture that the back end of the head part 204 and the front end of the body part 206 float form the placement surface 600 to make the front end of the head part 204 and the back end of the body part 206 contact the placement surface 600. When the robot 200 takes this posture, the robot 200 can be made to tremble efficiently by vibration control performed after this.

Figure 22:
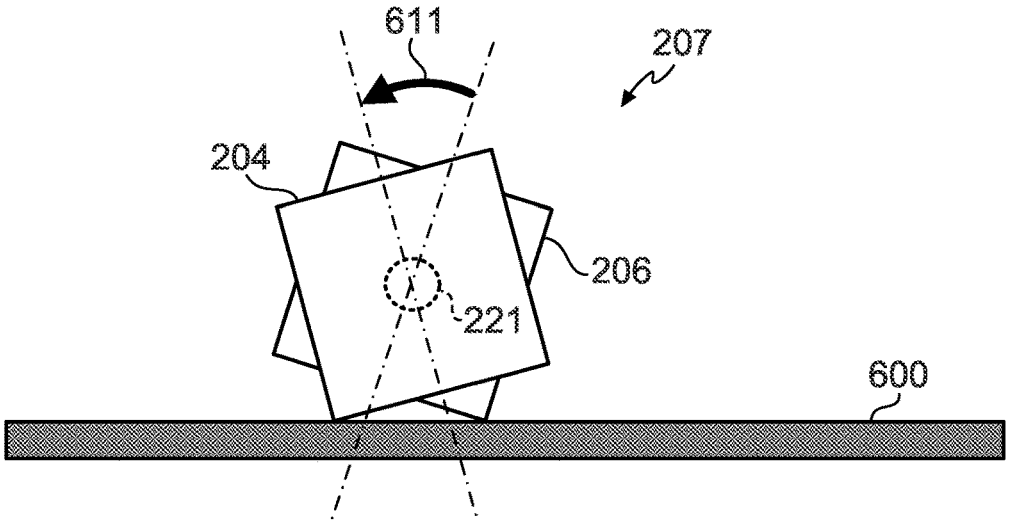
FIG. 22 is a diagram for describing an example of rotating forward the head part of the robot according to the embodiment.

Then, as illustrated in FIG. 22, the processing unit 110 instructs the twist motor 221 of the drive unit 220 to rotate the head part 204 forward by a first forward rotation angle 611 (step S163). The first forward rotation angle 611 is an angle of not less than 15 degrees and not more than 60 degrees (for example, 30 degrees).

Figure 23:
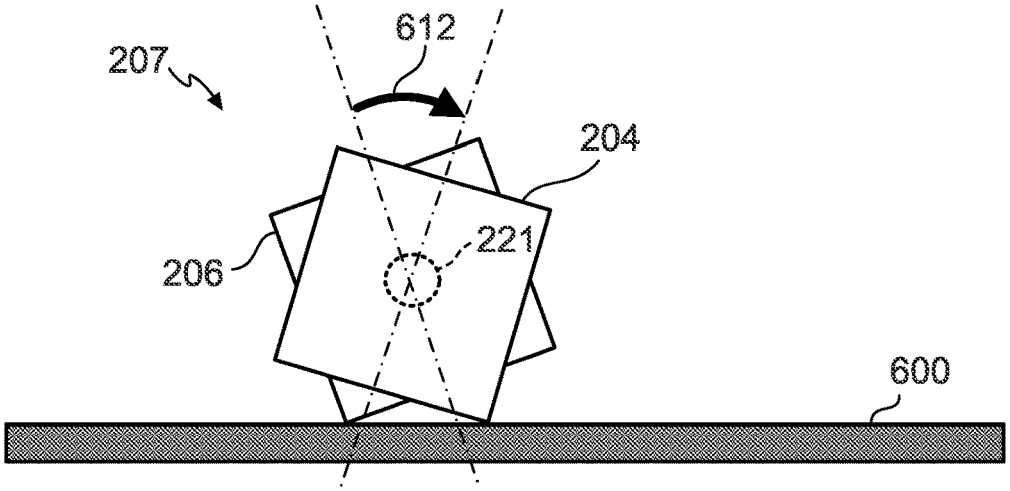
FIG. 23 is a diagram for describing an example of reversely rotating the head part of the robot according to the embodiment.

Next, the processing unit 110 waits for a first wait time (step S164). The first wait time is a time of not less than 0.03 seconds and not more than 0.1 seconds, which is 50 milliseconds, for example. Then, as illustrated in FIG. 23, the processing unit 110 instructs the twist motor 221 of the drive unit 220 to rotate the head part 204 reversely by a first reverse rotation angle 612 (step S165). The first reverse rotation angle 612 is an angle of not less than 15 degrees and not more than 60 degrees (for example, 30 degrees).

Next, the processing unit 110 waits for the first wait time (step S166). The first wait time is a time of 0.1 second or less, which is 50 milliseconds, for example. Then, the processing unit 110 subtracts 1 from the number of vibrations, N (step S167), and determines whether or not N is larger than 0 (step S168).

When the number of vibrations, N, is larger than 0 (step S168: Yes), the processing unit 110 returns to step S163. When the number of vibrations, N, is 0 or less (step S168: No), the processing unit 110 ends the vibration operation process.

In the vibration operation process described above, control from step S163 to step S166 is called unit vibration control, and control to repeat this unit vibration control as many as the number of vibrations, N, is called vibration control. As illustrated in FIG. 22 and FIG. 23, the head part 204 and the body part 206 rotate alternately to the other side by the vibration control. Therefore, the processing unit 110 can shake the body of robot 200 without a vibration motor by performing this control fast. Note that the time required to complete the operation by the unit vibration control once is called a first unit time.

There is a need to perform the vibration control fast in order to generate vibration effectively. Therefore, it is desired to set the first unit time to 0.3 seconds or less in order to make the robot 200 look like shaking its body in the vibration operation process described above. Further, in the vibration control, it is more important to set the time to reverse the rotation than to set the rotation angle. In the vibration operation process described above, fast reverse rotation is realized by reversing the rotation of the twist motor 221 immediately after waiting for the first wait time. When the first wait time is too short, the rotation angle is too small to make the vibration small. However, when the first wait time is too long, the vibration control cannot be performed fast. Therefore, it is desired to set the first wait time to a value of not less than 0.03 seconds and not more than 0.1 second.

Further, in the vibration operation process described above, the processing unit 110 instructs the twist motor 221 of the drive unit 220 to rotate the head part 204 reversely by the first reverse rotation angle 612 in step S165 after giving the instruction to rotate the head part 204 forward by the first forward rotation angle 611 in step S163, but step S163 and step S165 may be performed in reverse order. In other words, after giving, to the twist motor 221 of the drive unit 220, either one of an instruction to rotate forward by the first forward rotation angle 611 and an instruction to rotate reversely by the first reverse rotation angle 612, the processing unit 110 has only to give the other of the instruction to rotate forward by the first forward rotation angle 611 and the instruction to rotate reversely by the first reverse rotation angle 612.

In the remaining amount checking process, such an expression as to look like the robot 200 is sick can be made by shaking the body of the robot 200 by the vibration operation process according to the battery remaining amount, and the robot 200 can let the user know that the battery of the robot 200 needs to be charged without losing the sense of a creature.

Further, in the temperature checking process, such an expression as to look like the robot 200 is feeling cold can be made by shaking the body of the robot 200 by the vibration operation process according to the temperature, and the sense of a creature can further be improved.

Note that, in the behavior selection process described above, the emotional data 121 may be referred to upon the selection of a behavior of the robot 200 to reflect the values of the emotional data 121 in selecting the behavior. For example, a plurality of growth tables 123 may be prepared according to the values of the emotional data 121 to set types of behaviors to express emotions richly in order to select a behavior using a growth table 123 corresponding to the value of the emotional data 121 at the time, or the value of the behavior selection probability of each behavior recorded in the motion table 125 may be adjusted according to the value of the emotional data 121. In this case, the robot 200 can perform such a behavior as to more reflect current emotion.

Further, when the determination in step S107 of FIG. 14 is Yes, breathing movement or a behavior associated with the personality is performed as the spontaneous movement in the behavior selection process of step S106. At that time, a behavior according to the X value and the Y value of the emotional data 121 may be performed.

Further, since the Y value of the emotional data 121 corresponds to a degree of excitement in the positive direction and a degree of lethargy in the negative direction, the volume of barking/singing voice output from the robot 200 may be changed according to the Y value. In other words, the processing unit 110 may turn up the volume of barking/singing voice output from the speaker 231 as the Y value of the emotional data 121 is a positive larger value, and turn down the volume of barking/singing voice output from the speaker 231 as the Y value is a negative smaller value.

Further, plural variations of growth tables 123 may be prepared depending on the application of the robot 200 (such as to emotional education for toddlers or to talking with the elderly). Further, when the user wants to change the application of the robot 200 or the like, a corresponding growth table 123 may be able to be downloaded from an external server or the like through the communication unit 130.

Further, in the behavior selection process described above, the largest value among the four personality values is used as the growth value, but the growth value is not limited thereto. For example, the growth value may also be set based on the growth days data 126 (such as to use, as the growth value, a value obtained by dividing the growth days data 126 by a predetermined value (for example, by 10) and truncating after the decimal point). The personality value of the robot 200 abandoned by the user often remains small, and when the maximum value of the personality value is set as the growth value, no personality behavior may be selected. Even in such a case, if the growth value is set based on the growth days data 126, a personality behavior can be selected according to the growth days regardless of the frequency of care by the user. Further, the growth value may be set based on both the personality value and the growth days data 126 (such as to use, as the growth value, a value obtained by diving the sum of the largest value among the personality values and the growth days data 126 by a predetermined value, and truncating after the decimal point).

Further, in the above-described embodiment, the personality value is set based on the emotional change data 122, but the personality value setting method is not limited to this method. For example, the personality value may also be set directly from the external stimulus data based not on the emotional change data 122. For example, it is considered a method for increasing the personality value (active) when being rubbed and decreasing the personality value (shy) when being hit. Further, the personality value may be set based on the emotional data 121. For example, it is considered a method for setting, as the personality value, a value obtained by reducing the X value and the Y value of the emotional data 121 to 1/10, respectively.

According to the behavior control processing described above, can make the robot 200 have pseudo emotions (emotional data 121). Further, since each robot 200 comes to express different emotional changes according to the external stimuli by learning the emotional change data 122 to change the emotional data 121 according to the external stimuli, each robot 200 can be made to have a pseudo personality (personality value). Further, since the personality is derived from the emotional change data 122, a clone robot having the same personality can be generated by copying the emotional change data 122. For example, if backup data of the emotional change data 122 is stored, a robot 200 having the same personality can be reproduced by restoring the backup data even when the robot 200 is broken down.

Then, since the variations of behaviors capable of being selected become richer as the growth value calculated based on the personality value increases, richer behaviors can be expressed as the robot 200 pseudo-grows (as the growth value increases). Further, as the growth of the robot 200 progress, the robot 200 does not perform only the behavior after growing up, and a behavior can be selected according the behavior selection probability defined in the growth table 123 from among all behaviors that have been performed before then. Therefore, the user can see a behavior at the beginning of purchase even after the robot 200 grows up, and the user can feel more affection.

Further, since the pseudo growth of the robot 200 is limited to the first period (for example, 50 days) and the emotional change data 122 (personality) is fixed after that, the robot 200 cannot be reset like other ordinary equipment, and this can give the user a feeling as if the user was in contact with a really alive pet.

Further, since the pseudo emotion is represented by plural pieces of emotional data (X and Y of the emotional data 121), and the pseudo personality is represented by plural pieces of emotional change data (DXP, DXM, DYP, and DYM of the emotional change data 122), complex emotion and personality can be expressed.

Then, since the emotional change data 122 used to derive this pseudo personality is learned according to each of the plural types of external stimuli different from one another acquired by the plural sensors included in the sensor unit 210, a wide variety of pseudo personalities can be generated depending on how the user contacts the robot 200.

(Modifications)

Note that the present disclosure is not limited to the above-described embodiment, and various modifications and applications are possible. For example, for users who do not think that it is necessary to make the robot 200 have emotions and personalities, the processes related to the emotion and personality may be omitted in the behavior control processing. In this case, the growth value may be derived from the growth days data 126. The process related to the growth value may also be so omitted that the growth table 123 is configured to determine the behavior type uniquely for each behavioral trigger. In this case, a behavior selected according to the behavioral trigger has only to be executed in the behavior selection process.

Further, in the motion table 125 described above, the operation of the drive unit 220 of the robot 200 (operating time and operating angle), and voice data are set, but only the operation of the drive unit 220 or only the voice data may also be set. Further, control of any item other than the operation of the drive unit 220 and the voice data may be set. For example, when the output unit 230 of the robot 200 is equipped with an LED, it is considered that the color or brightness of the LED that lights up is controlled as the control of any item other than the operation of the drive unit 220 and the voice data. As a unit to be controlled by the processing unit 110, at least either one of the drive unit 220 and the output unit 230 should be included. Then, the output unit 230 may output only sound as a sound output unit or output only light by the LED or the like.

Further, in the above-described embodiment, the size of the emotional map 300 is enlarged to increase both the maximum value and the minimum value by 2 each time the number of pseudo growth days of the robot 200 increases by one day during the first period. However, the enlargement of the size of the emotional map 300 does not have to be done evenly in this way. For example, the way of enlarging the emotional map 300 may be changed depending on how the emotional data 121 changes.

For example, in order to change the way of enlarging the emotional map 300 depending on how the emotional data 121 changes, processes below may be performed in step S114 of the behavior control processing (FIG. 14). When a value of the emotional data 121 is set to the maximum value of the emotional map 300 even once in step S105 on a day, the maximum value of the emotional map 300 increases by 3 in step S114 after that. On the other hand, when no value of the emotional data 121 reaches the maximum value of the emotional map 300 even once in step S105, the maximum value of the emotional map 300 increases by 1 in step S114 after that.

Similarly, when a value of the emotional data 121 is set to the minimum value of the emotional map 300 even once on that day, the smallest value of the emotional map 300 decreases by 3, while when no value of the emotional data 121 reaches the minimum value of the emotional map 300 even once, the smallest value of the emotional map 300 decreases by 1. Thus, the settable range of the emotional data 121 is learned according to the external stimulus by changing the way of enlarging the emotional map 300.

Note that the emotional map is always enlarged during the first period in the embodiment and the modification described above, but the change in the range of the emotional map is not limited to the enlargement. For example, the range of the emotional map in a direction of emotion that rarely occurs may be shrunk according to the external stimulus.

Figure 24:
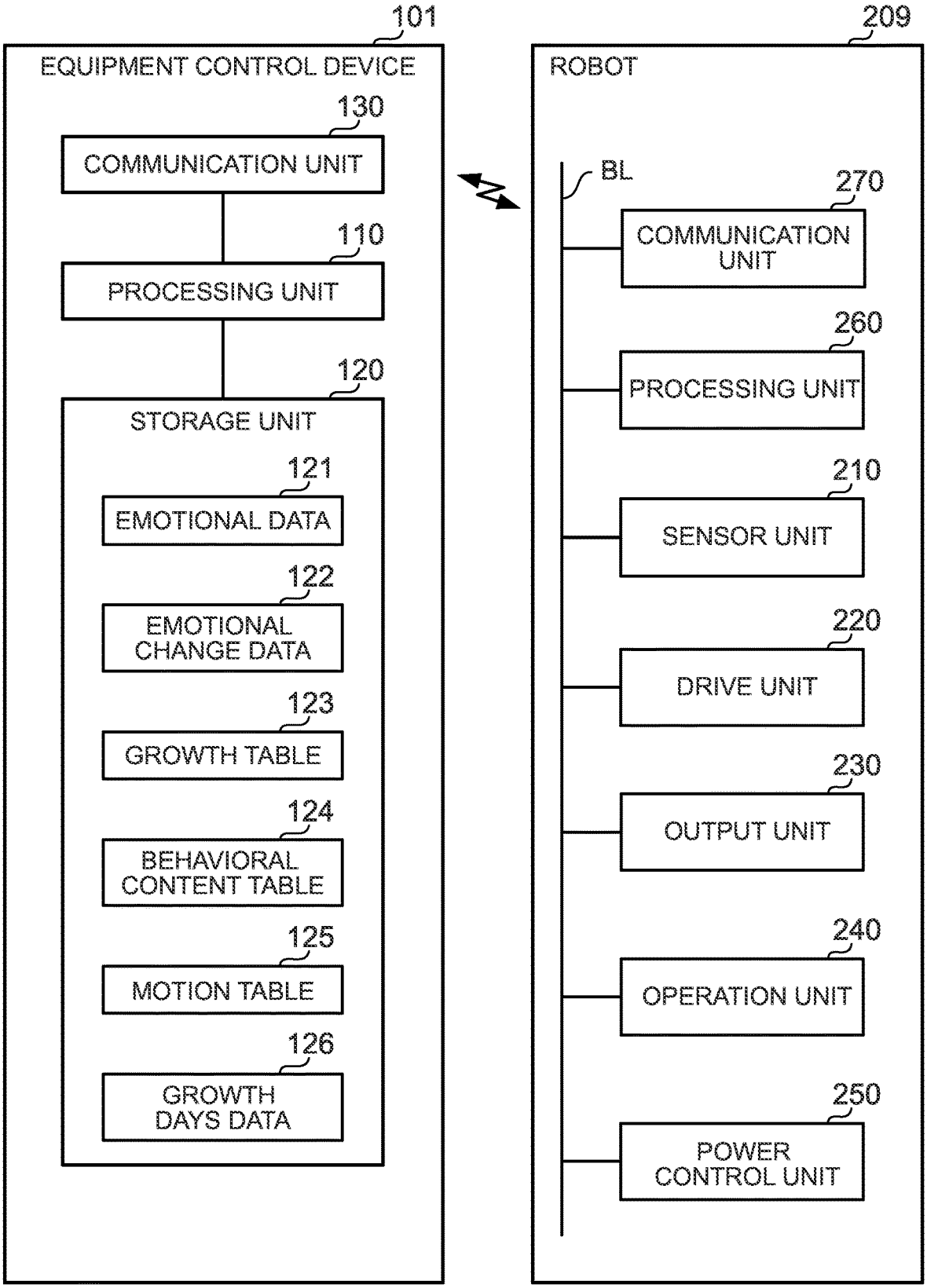
FIG. 24 is a block diagram illustrating the functional configuration of an equipment control device and a robot according to a modification.

Further, in the above-described embodiment, the equipment control device 100 is built in the robot 200, but the equipment control device 100 does not necessarily have to be built in the robot 200. For example, as illustrated in FIG. 24, an equipment control device 101 may also be a separate device (for example, a server) without being built in a robot 209. In this modification, the robot 209 also includes a processing unit 260 and a communication unit 270 in such a manner that the communication unit 130 and the communication unit 270 can transmit/receive data from/to each other. Then, the processing unit 110 acquires external stimuli detected by the sensor unit 210 through the communication unit 130 and the communication unit 270, acquires the battery remaining amount from the power control unit 250, and controls the drive unit 220 and the output unit 230.

Note that when the equipment control device 101 and the robot 209 are thus configured as separate devices, the robot 209 may also be controlled by the processing unit 260 as needed. For example, simple behavior is controlled by the processing unit 260, and complex behavior is controlled by the processing unit 110 through the communication unit 270.

Further, in the embodiment and the modification described above, the equipment control device 100 (101) is a control device that targets at the robot 200 (209) as equipment to be controlled, but the equipment to be controlled is not limited to the robot 200 (209). As equipment to be controlled, for example, a wristwatch or the like can also be considered. For example, when a wristwatch capable of outputting voice and equipped with an acceleration sensor is equipment to be controlled, impact applied to the wristwatch and detected by the acceleration sensor, and the like can be assumed as an external stimulus. Then, voice data output according to the external stimulus can be recorded in the motion table 125. Then, it is considered that the emotional data 121 and the emotional change data 122 are updated according to the external stimulus, and voice data set in the motion table 125 is output based on the detected external stimulus and the emotional change data 122 (personality) at the time.

This makes the wristwatch have a personality (pseudo personality) depending on how the user handles the wristwatch. In other words, even wristwatches having the same model number, when the user handles a wristwatch with care, the wristwatch has s cheerful personality, while when the user roughly handle a wristwatch, the wristwatch has a shy personality.

Thus, the equipment control device 100 (101) can be applied to a variety of equipment without being limited to the robot. Then, equipment can have pseudo emotion or personality by applying the equipment control device to the equipment, and the user can feel as if the user was bringing up the equipment in a pseudo manner.

In the above-described embodiment, an operation program executed by the CPU of the processing unit 110 is prestored in the ROM or the like in the storage unit 120. However, the present disclosure is not limited thereto, and the operation program to execute the various processes described above may also be implemented on an existing general-purpose computer or the like to make the general-purpose computer or the like function as a device corresponding to the equipment control device 100 (101) according to the embodiment and the modification described above.

The method of providing such a program is optional. For example, the program may be stored on a computer-readable recording medium (such as a flexible disk, a CD (Compact Disc)-ROM, a DVD (Digital Versatile Disc)-ROM, an MO (Magneto-Optical Disc), a memory card, or a USB memory) and distributed, or the program may be stored in a storage on a network such as the Internet and downloaded to provide the program.

Further, when the above-described processing is executed in a shared manner between an OS (Operating System) and an application program or in collaboration between the OS and the application program, only the application program may be stored on the recording medium or in the storage. Further, the program can be superimposed in carrier waves and delivered through the network. For example, the above-mentioned program may be posted on a bulletin board (Bulletin Board System: BBS) on the network and delivered through the network. Then, this program may be launched and executed under the control of the OS in the same manner as any other application program so that the above-mentioned processing can be executed.

Further, the processing unit 110 (260) may be configured by any processor alone, such as a single processor, a multiprocessor, or a multi-core processor, or may be configured by any processor in combination with a processing circuit such as an ASIC (Application Specific Integrated Circuit) or an FPGA (Field-Programmable Gate Array).

The present disclosure can include various embodiments and modifications without departing from the broad spirit and scope of the present disclosure. Further, the above-described embodiment is to describe this invention, and is not to limit the scope of the present disclosure. In other words, the scope of the present disclosure is encompassed by the scope of appended claims, rather than the embodiment. Then, various modifications made within the scope of appended claims and within the scope of significance of equivalent inventions should be considered within the scope of this invention.

What is claimed is:

1. A robot comprising:

a body part configured to contact a placement surface;

a head part connected to a front end of the body part and configured to contact the placement surface, the head part being rotatable about (i) a first axis of rotation extending in a front-back direction of the body part, and (ii) a second axis of rotation extending in a width direction of the body part;

a drive unit which performs a rotation of the head part about the first axis of rotation and a rotation of the head part about the second axis of rotation independently of each other; and a processor, wherein the processor controls the drive unit to:

perform preparation control to rotate the head part about the second axis of rotation to a preparation angle; and after performing the preparation control, performing vibration control to alternately repeat forward rotation and reverse rotation of the head part about the first axis of rotation while both the body part and the head part remain in contact with the placement surface.

2. The robot according to claim 1, wherein the preparation angle is an angle at which a back end of the body part and a front end of the head part contact the placement surface, and the front end of the body part and a back end of the head part do not contact the placement surface.

3. The robot according to claim 2, wherein the vibration control comprises repeating a unit vibration control in which the processor gives, to the drive unit, one of an instruction to perform forward rotation of the head part and an instruction to perform reverse rotation of the head part about the first axis of rotation after giving the other of the instruction to perform the forward rotation of the head part and the instruction to perform the reverse rotation of the head part about the first axis of rotation.

4. The robot according to claim 3, wherein the unit vibration control comprises waiting for a first wait time after giving, to the drive unit, one of an instruction to perform the forward rotation of the head part about the first axis of rotation up to a first forward rotation angle and an instruction to perform the reverse rotation of the head part about the first axis of rotation up to a first reverse rotation angle, and after that, waiting for the first wait time after giving the other of the instruction to perform the forward rotation of the head part about the first axis of rotation up to the first forward rotation angle and the instruction to perform the reverse rotation of the head part about the first axis of rotation up to the first reverse rotation angle.

5. The robot according to claim 4, wherein the first wait time is a time of not less than 0.03 seconds and not more than 0.1 seconds.

6. The robot according to claim 3, wherein the processor controls the drive unit to perform operation by the unit vibration control within a first unit time.

7. The robot according to 6, wherein the first unit time is 0.3 seconds or less.

8. A control method for a robot, the robot including a body part configured to contact a placement surface, a head part connected to a front end of the body part and configured to contact the placement surface, and a drive unit, the head part being rotatable about (i) a first axis of rotation extending in a front-back direction of the body part, and (ii) a second axis of rotation extending in a width direction of the body part, the drive unit being configured to perform a rotation of the head part about the first axis of rotation and a rotation of the head part about the second axis of rotation independently of each other, and the control method comprising:

performing preparation control including controlling the drive unit to rotate the head part about the second axis of rotation to a preparation angle; and after performing the preparation control, controlling the drive unit to alternately repeat forward rotation and reverse rotation of the head part about the first axis of rotation while both the body part and the head part remain in contact with the placement surface.

9. A non-transitory storage medium storing a program for a robot, the robot including a body part configured to contact a placement surface, a head part connected to a front end of the body part and configured to contact the placement surface, and a drive unit, the head part being rotatable about (i) a first axis of rotation extending in a front-back direction of the body part, and (ii) a second axis of rotation extending in a width direction of the body part, the drive unit being configured to perform a rotation of the head part about the first axis of rotation and a rotation of the head part about the second axis of rotation independently of each other, and the program being executable to cause a computer controlling the robot to execute processes comprising:

performing preparation control including controlling the drive unit to rotate the head part about the second axis of rotation to a preparation angle; and after performing the preparation control, controlling the drive unit to alternately repeat forward rotation and reverse rotation of the head part about the first axis of rotation while both the body part and the head part remain in contact with the placement surface.

* * * * *